US005533821A

United States Patent [19]

Awai et al.

[11] Patent Number: 5,533,821

[45] Date of Patent: Jul. 9, 1996

[54] CURL CORRECTION APPARATUS

[75] Inventors: Takashi Awai; Keizo Sasai, both of Yokohama, Japan

[73] Assignee: Canon Kabushiki Kaisha, Tokyo, Japan

[21] Appl. No.: 487,912

[22] Filed: Jun. 7, 1995

Related U.S. Application Data

[63] Continuation of Ser. No. 123,206, Sep. 20, 1993, abandoned, which is a continuation of Ser. No. 794,838, Nov. 21, 1991, abandoned, which is a continuation of Ser. No. 445,993, Dec. 4, 1989, abandoned.

[30] Foreign Application Priority Data

| | | | |
|---|---|---|---|
| Dec. 5, 1988 | [JP] | Japan | 63-305951 |
| Dec. 8, 1988 | [JP] | Japan | 63-308815 |
| Jul. 27, 1989 | [JP] | Japan | 1-192631 |
| Jul. 27, 1989 | [JP] | Japan | 1-192632 |

[51] Int. Cl.[6] ..... B41J 15/16

[52] U.S. Cl. ..... 400/619; 400/618; 400/621; 347/219; 358/296

[58] Field of Search ..... 400/208, 551, 400/611, 613, 618, 619, 621, 636, 642, 649, 690.4, 692; 101/288; 346/1361145; 347/215, 218, 219; 226/188; 271/207, 272; 355/309; 358/296, 304

[56] References Cited

U.S. PATENT DOCUMENTS

| | | | |
|---|---|---|---|
| 1,296,191 | 3/1919 | Ireland | 400/613 |
| 3,389,401 | 6/1968 | Neff | 346/136 |
| 3,567,143 | 3/1971 | Hesse | 400/619 |
| 3,593,833 | 7/1971 | Bretti | 400/613 |
| 4,119,974 | 10/1978 | Onaks et al. | 346/145 |
| 4,165,029 | 8/1979 | Mitchell | 400/613 |
| 4,223,325 | 9/1980 | Ebert | 346/136 |
| 4,860,031 | 8/1989 | Lejcek | 400/613 |

FOREIGN PATENT DOCUMENTS

| | | | |
|---|---|---|---|
| 662448 | 4/1963 | Canada | 400/611 |
| 55-48057 | 4/1980 | Japan . | |
| 59-59483 | 4/1984 | Japan | 400/613 |
| 61-8369 | 1/1986 | Japan | 400/642 |
| 61-68277 | 4/1986 | Japan | 400/692 |
| 61-163883 | 7/1986 | Japan | 400/642 |
| 61-238647 | 10/1986 | Japan . | |
| 62-175377 | 8/1987 | Japan . | |
| 63-74862 | 4/1988 | Japan . | |
| 2171082 | 8/1986 | United Kingdom | 400/613 |

OTHER PUBLICATIONS

T. J. Kotasek; "Roll Feed Blousing Bail"; *IBM Tec Disc Bull;* vol. 24, No. 11B, p. 5947, Apr. 1982.

*Primary Examiner*—David A. Wiecking

*Attorney, Agent, or Firm*—Fitzpatrick, Cella, Harper & Scinto

[57] ABSTRACT

This invention relates to a curl correction apparatus comprising holder means for holding a rolled sheet material; transport means for transporting the sheet material housed in said holder means; a curl correction member positioned between said holder means and said transport means and adapted to guide said sheet material in a curved state for correction of the curl thereof; a guide member contacting a face of said sheet material opposite to the face guided by said curl correction member and serving to guide said sheet material to said curl correction member; and moving means for moving at least one of said curl correction member and said guide member according to the amount of said sheet material remaining in said holder means.

65 Claims, 25 Drawing Sheets

CURL CORRECTION APPARATUS

This application is a continuation of application Ser. No. 08/123,206, filed Sep. 20, 1993, now abandoned, which is a continuation of application Ser. No. 07/794,838, filed Nov. 21, 1991, now abandoned, which is a continuation of application Ser. No. 07/445,993, filed Dec. 4, 1989, now abandoned.

BACKGROUND OF THE INVENTION

1. Field of the Invention

The present invention relates to a curl correcting apparatus for correcting curling of a rolled sheet material.

2. Related Background Art

The recording system of various office equipment such as a facsimile or printer generally employs a continuous web-shaped recording sheet wound in a roll form.

Because of the rolled form, the sheet material tends to show curling. For this reason there have been proposed technologies for removing or reducing said curling.

As an example of said technologies, FIG. 23 illustrates a curl eliminating apparatus, in which a main body 1 and a cover 2 are mutually articulated movably by a pin 3. In the main body 1 there are provided a roll holder 4, a platen roller 5, a cutter 6 and a guide member 7*a* constituting the curl eliminating device, while the cover 2 holds a recording head 8 and a guide member 7*b* constituting the curl eliminating device in cooperation with the guide member 7*a*. Said roll holder 4 supports a roll 9*a* of the sheet material 9.

The sheet material 9 fed from said roll 9*a* is transported by the platen roller 5, and the curl is removed in passing an acute angled path formed by the guide members 7*a*, 7*b*. Then the sheet is subjected to image formation by the recording head 8, cut by the cutter 6 and discharged from the apparatus.

In the conventional structure shown in FIG. 23, the sheet material 9 remains bent between the guide members 7*a*, 7*b* in the stand-by state of the apparatus. Thus the sheet material 9 between said guide members 7*a*, 7*b* generates curling in a direction opposite to that generated by winding, and such curling may give rise to troubles such as sheet jamming. Also the guide members 7*a*, 7*b* of fixed angle may be unable to adequately remove the curling which varies according to the diameter of the roll 9*a* .

FIG. 24 illustrates another example of the already proposed curl removing apparatus. The clockwise rotation of the platen roller 5 is transmitted, through a frictional clutch, to a guide shaft 10 and arms 11 provided on both ends of said shaft 10. At the outer end of the arms 11, there is rotatably supported a curl correction shaft 12. In predetermined positions of the main body 1, there are fixed stoppers 13, 14 for limiting the movement of the arms 11, which is constantly biased toward the stopper 13 by means of a spring.

The sheet material 9 is transported by the platen roller 5, of which rotation is transmitted to the guide shaft 10 thereby rotating the arms 11 clockwise. When the arms 11 impinge on the stopper 14, the rotation of the arms 11 is stopped by the slippage of the frictional clutch. The sheet material 9 is bent in acute angle in a path from the roll 9*a*, through the guide shaft 10, to the curl correction shaft 12 for curl correction, and is then transported to the platen roller 5.

When the rotation of the platen roller 5 is terminated, the arms 11 rotate anticlockwise by the biasing force of the spring and returns to the position in contact with the stopper 13.

In this conventional structure, the curling on the sheet material 9 is removed by the guide shaft 10 and the curl correction shaft 12 mounted on the arms 11 rotated by the transportation of the sheet material 9.

In the conventional structure shown in FIG. 24, in loading a new roll 9*a* in the roll holder 4, the leading end of the sheet material 9 has to be threaded between the guide shaft 10 and the curl correction shaft 12, so that a cumbersome some operation is required. Also the sheet material 9 subjected to curl correction by the shaft 12 shows a large wrapping angle on the platen roller 5, thus eventually developing curl again. Also in the standby state of the apparatus, the sheet material 9 hangs down between the platen roller 5 and the roll 9*a*, thereby curl opposite to the curl of rolling. Also the main body 1 has to be made larger in order to accommodate the rotation of the arms 11 about the guide shaft 10 for curl correction of the sheet material 9.

Also the curl correction apparatus disclosed in the Japanese Patent Laid-open No. 55-15381 is associated with a drawback of curl generation opposite to the curl by rolling, since the sheet material remains bent for curl correction in the stand-by state of the apparatus.

SUMMARY OF THE INVENTION

The object of the present invention is to provide a curl correction mechanism capable of adequately correcting the curl of a sheet material varying according to the diameter of roll, and a recording apparatus equipped with such mechanism.

The above-mentioned object can be achieved, according to the present invention, by a curl correction mechanism provided with transport means for transporting a sheet material; a guide member for guiding said sheet material; a curl correction member for guiding said sheet material through a bent path; moving means for moving at least one of said guide member and said curl correction member; and biasing means for biasing said moving means in such a direction as to increase the bend of the sheet material.

In another structure, there are provided transport means for transporting the sheet material; a curl correction member positioned in the upstream side of said transport means in the transport direction of the sheet material for guiding said sheet material; and a guide member positioned in the upstream side of said curl correction member in the transport direction of the sheet material, for guiding said sheet material which is moved by interaction of the tension on said sheet material and the power transmitted thereto.

Also there is preferably provided retracting means composed of a rotatable member supporting the curl correction member or a moving member for moving said curl correction member in relation to the opening motion of the cover.

The above-mentioned recording apparatus is featured by recording means for forming an image, in response to image signal, on a sheet material transported by the transport means, and said curl correction mechanism positioned in the upstream side of said recording means in the transport direction of the sheet material.

In the above-explained structure, the curl correction member is positioned in the upstream side of the transport means, for transporting the sheet material, in the transport direction thereof and the guide member is positioned in the upstream side of said curl correction member and is rendered movable by the interaction of the tension on said sheet material and the power for moving said guide member, so that the curling of the sheet material can be corrected according to the tension acting on said sheet material.

The curl developed in a rolled sheet material generally depends on the diameter of roll, becoming stronger as the roll diameter decreases.

On the other hand, the tension on the sheet material depends on the contact friction between the rolled sheet material and the holder supporting said roll. For a larger roll diameter, the tension is higher because of the larger roll weight, and the tension is smaller for a smaller roll diameter.

While the sheet material is transported by said transport means, the power of the drive means is transmitted to the guide member, which is therefore moved and brought into contact with the transported sheet material. The guide member continues to move after contacting the sheet material, and stops at a position where the moving force for the guide member balances with the synthesized tension on the sheet material. Consequently the amount of movement of the guide member varies according to the tension applied to the sheet material.

When the guide member stops as explained above, the sheet material is wound around the guide member and the curl correction member, in a direction same as the direction of curling around the guide member and opposite to the direction of curling around the curl correction member, so that the curling of the sheet material is corrected by wrapping around said curl correction member.

The amount of wrapping of said sheet material around the curl correction member varies according to the amount of movement of the guide member. More specifically, when the sheet material is under a higher tension, the guide member moves less and the wrapping amount of the sheet material on the curl correction member becomes less, so that the corrective action on the sheet material is reduced. On the other hand, when the sheet material is under a lower tension, the guide member moves more to increase the wrapping amount of the sheet material on the curl correction member, thereby increasing the corrective action on the sheet material.

If the curl correction member is made retractable from the working position by the opening of the cover, even when the guide member and the curl correction member are involved in the sheet jamming developed in the course of curl correction, the disposal of such sheet jamming can be easily made by retracting the curl correction member by opening the cover.

Also the loading of the roll is facilitated since the curl correction member is retractable from the working position by the opening of the cover and the threading of the leading end of the sheet material through the curl correction member is not necessary.

Furthermore it is rendered possible to correct the curling of the sheet material in a recording apparatus by incorporating said curl correction mechanism in the apparatus, and to reduce the possibility of troubles such as sheet jamming, resulting from the curling of the sheet material.

DETAILED DESCRIPTION OF THE PREFERRED EMBODIMENTS

Now, the present invention will be clarified in detail by embodiments thereof applied in a recording apparatus.

Figure 1:
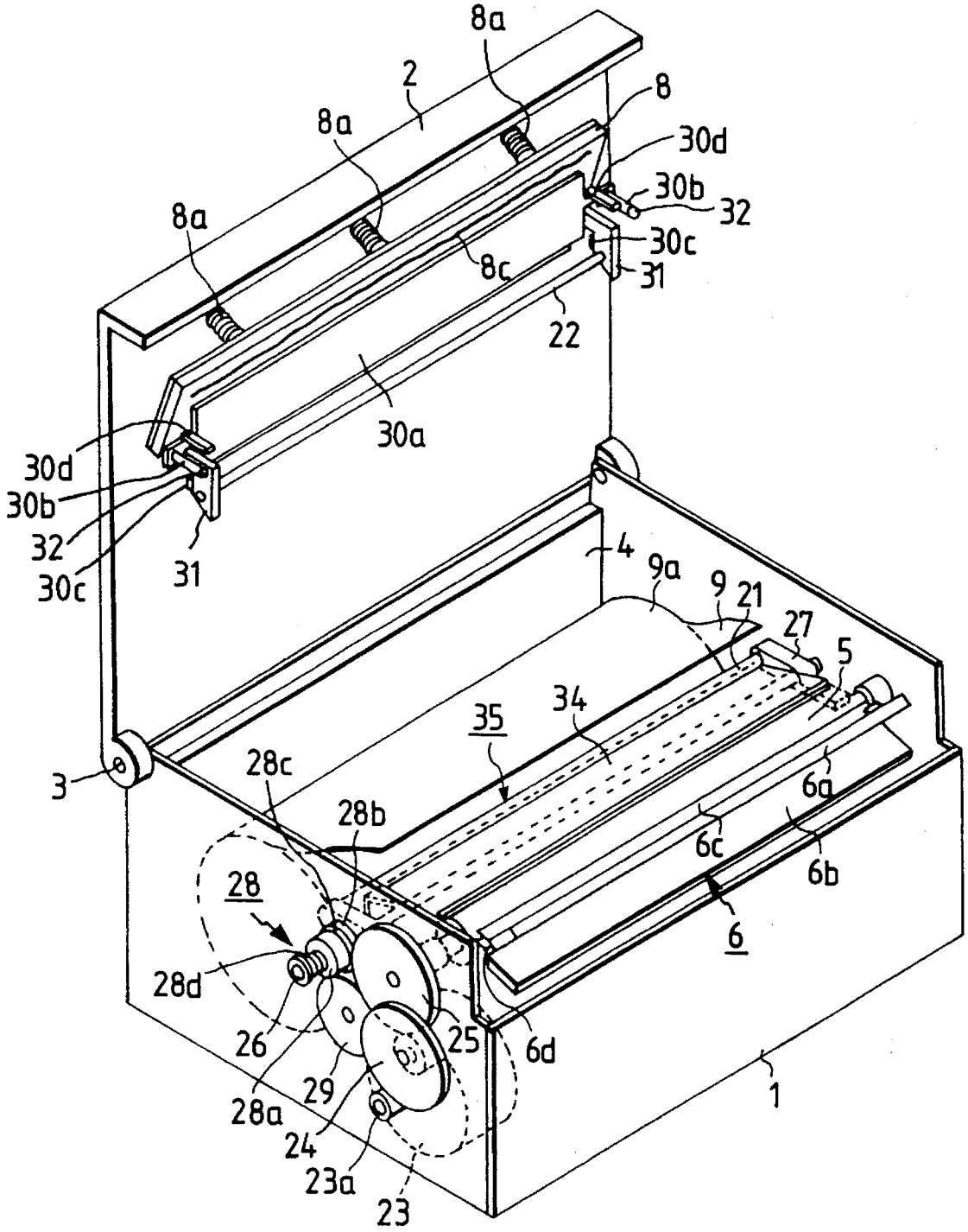
FIG. 1 is a schematic perspective view of a recording apparatus.
Figure 2A:
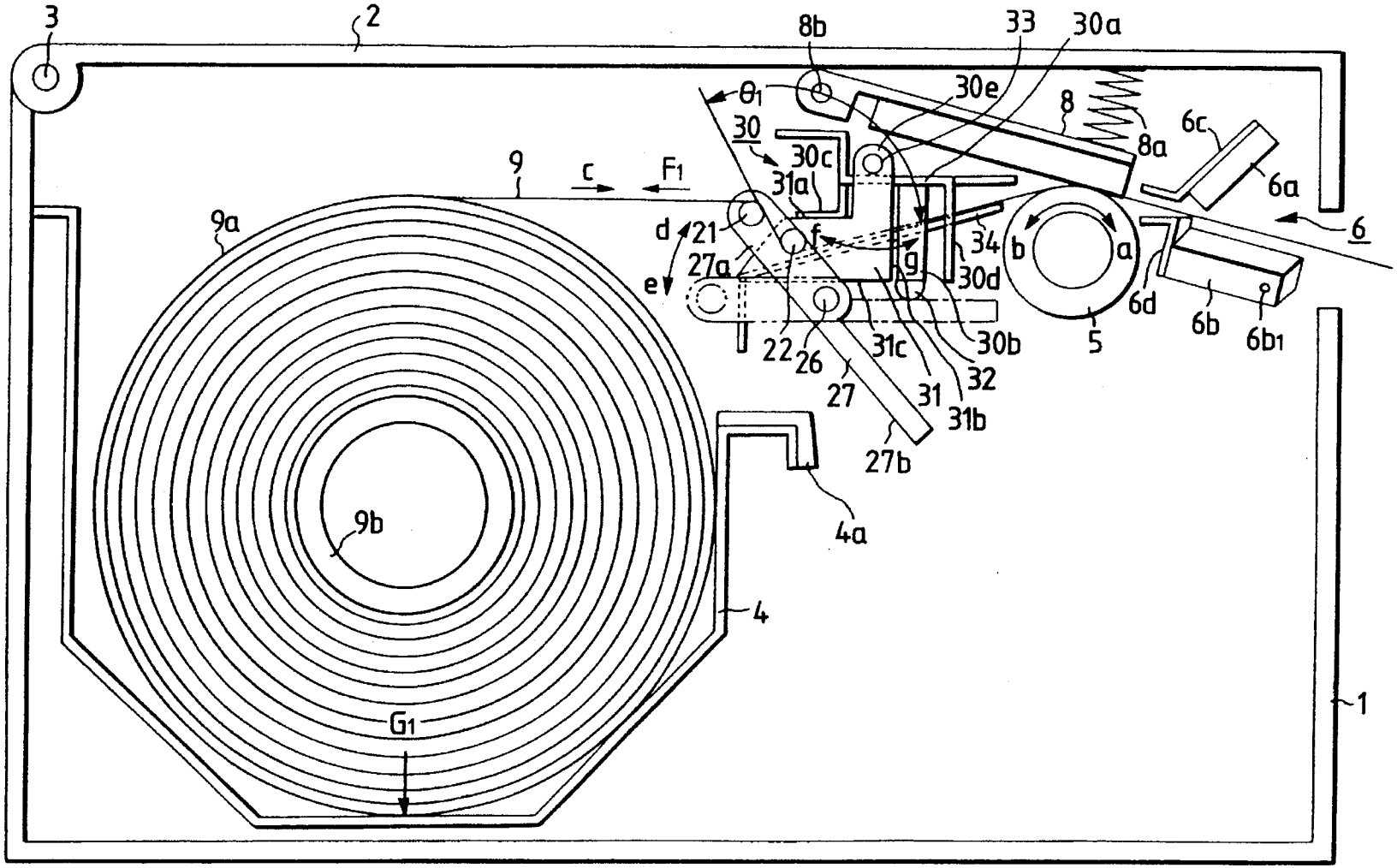
FIGS. 2A and 2B are views showing the principle of curl correction.
Figure 2B:
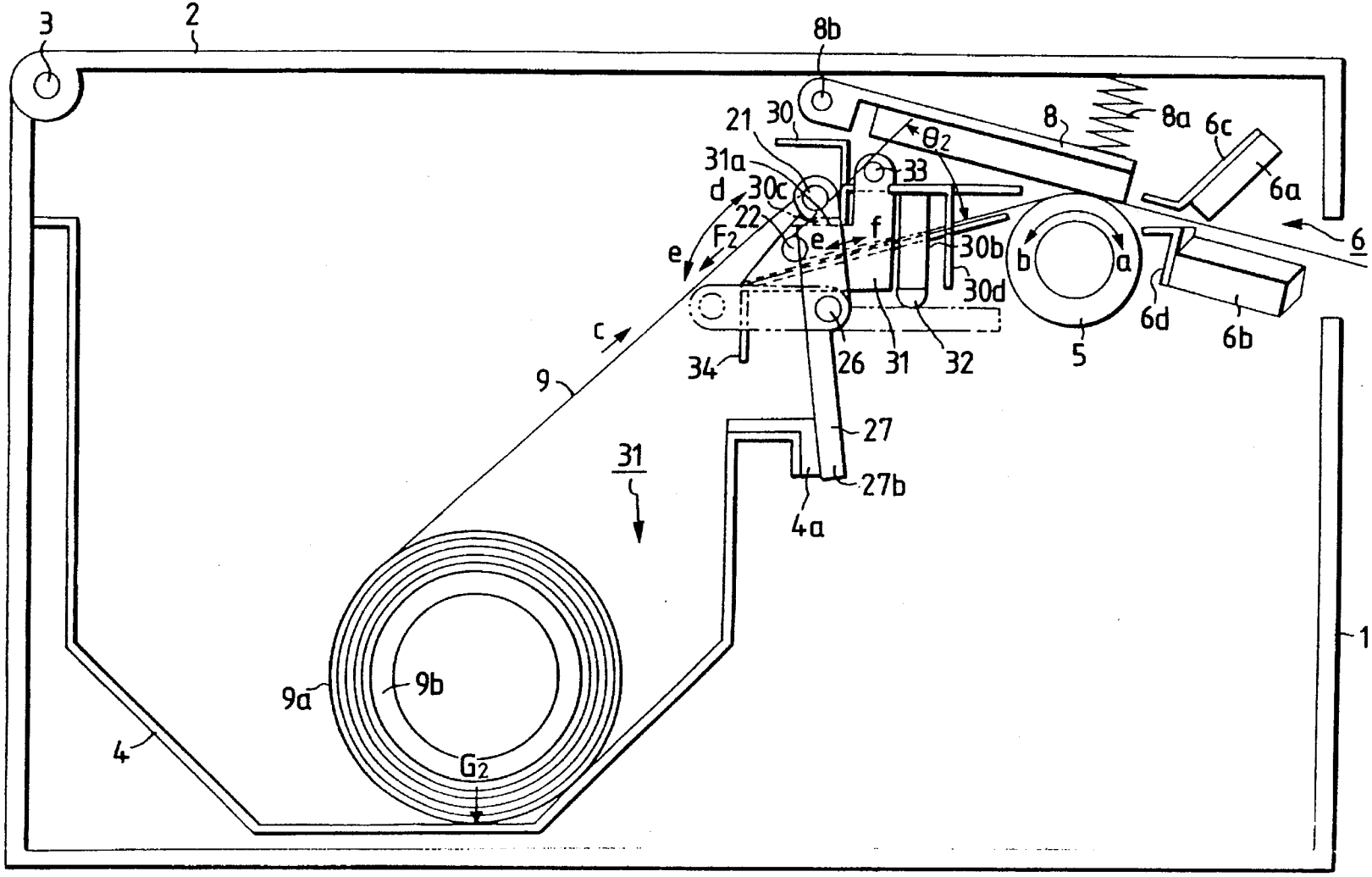
Figure 3A:
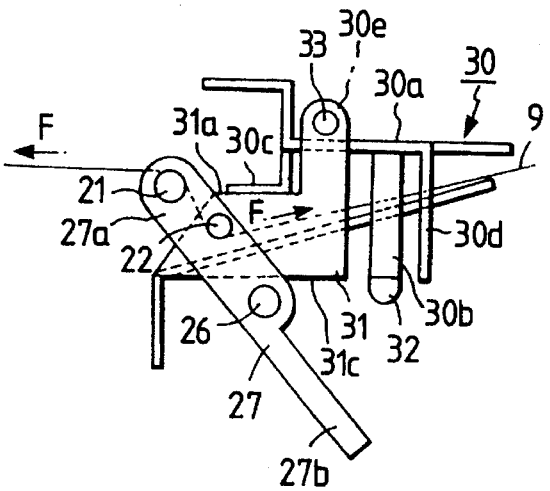
FIGS. 3A and 3B are magnified views of a part of FIGS. 2A and 2B.
Figure 3B:
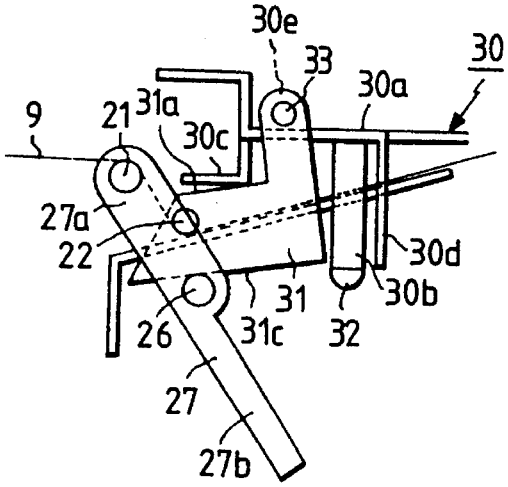
Figure 4A:
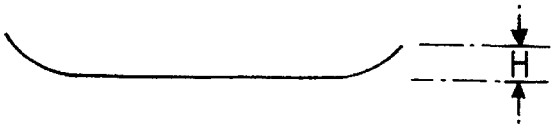
FIGS. 4A and 4B are schematic views of curl in a sheet material.
Figure 4B:
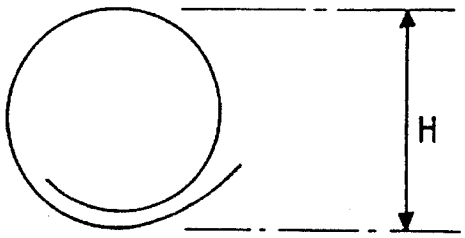
Figure 5:
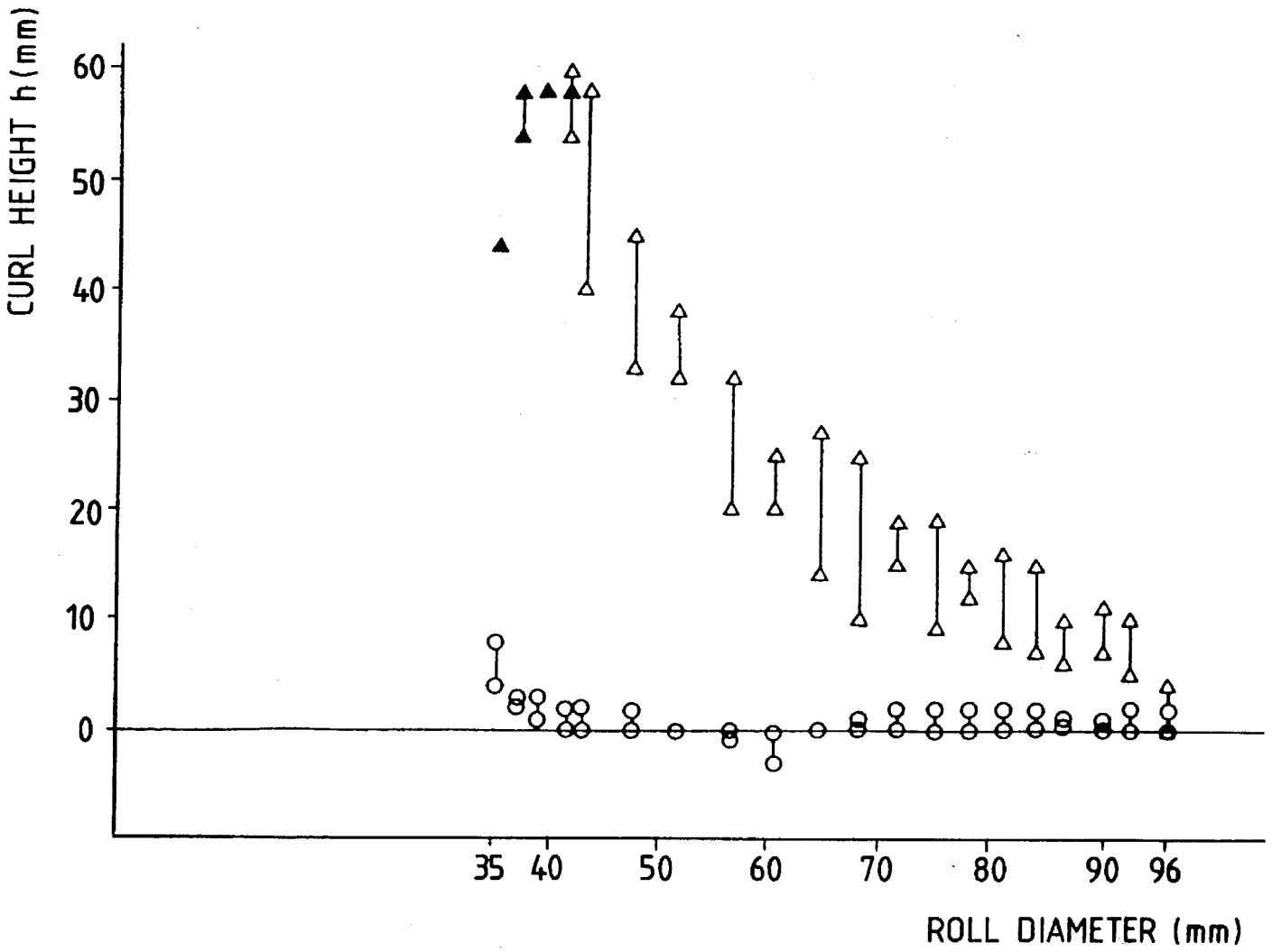
FIG. 5 is a chart showing experimental results.

FIG. 1 is a schematic perspective view of a recording apparatus; FIGS. 2A and 2B are views showing the principle of curl correction; FIGS. 3A and 3B are partial magnified views thereof; FIG. 4 is a schematic view of curling of a sheet material; and FIG. 5 is a chart showing experimental results.

At first there will be briefly explained the structure of the recording apparatus.

A cover 2 is rotatably articulated by a shaft 3 on a main body 1, and is made engageable with the main body 1 by a click mechanism (not shown). In a rear part of the main body 1 there is provided a roll holder 4, in which a roll 9*a* of sheet material 9 such as plain paper or thermal recording paper is loaded. The sheet material 9 extracted from the roll 9*a* goes around a guide shaft 21 constituting the guide member and a curl correction shaft 22 constituting the curl 10 correction member, and is transported by a platen roller 5. A recording head 8, mounted on the cover 2 by means of a compression spring 8*a*, is maintained in pressure contact with said platen roller 5. An image is formed on the sheet material 9 by driving the recording head 8 according to image signals supplied from a control unit (not shown) while the sheet material 9 is transported by the platen roller 5. After said image formation, the sheet material 9 is cut by a cutter 6 and discharged from the apparatus.

In the above-explained structure, the curl of the sheet material 9 is corrected by the wrapping thereof around the curl correction shaft 22. The amount of movement of the guide shaft 21 varies according to the weight of the roll 9*a* loaded in the roll holder 4, thereby varying the angle θ of the sheet 9 around the curl correction shaft 22. If said angle θ is larger, or the wrapping amount of the sheet 9 on the curl correction shaft 22 is larger, the curl correcting effect becomes smaller, and vice versa.

In the following there will be explained various parts of the apparatus.

The roll holder 4 is shaped as a polygon open on the top, and is positioned in the rear part of the main body 1. A part of the wall of said roll holder 4 at the side of platen roller 5 is folded to constitute a stopper 4*a* for an arm 27 to be explained later. The roll 9*a* is loaded in the roll holder 4, and a frictional resistance is generated by the contact between the external periphery of said roll 9*a* and the internal wall of said roll holder 4. Said frictional resistance is large when the roll 9*a* is large in diameter and heavy, but decreases as the roll 9*a* becomes lighter.

Said stopper 4*a* is constructed in such a manner that, when in contact with a contactor 27*b* of the arm 27, the angle θ of the sheet material 9 around the curl correction shaft 22 becomes about 30° by the function of a guide shaft 21 mounted on said arm 27.

The platen roller 5 is driven by a motor 23 such as a stepping motor. The rotation of said motor 23 is transmitted, from a gear 23*a* mounted thereon, to a gear 25 mounted on the platen roller 5 through an intermediate gear 24. The recording head 8 is maintained in pressure contact with the platen roller 5 across the sheet material 9, which is transported by said platen roller 5.

Said motor 23 is controlled by a control unit to rotate the platen roller in a direction a or b. In the image formation on the sheet material 9, the platen roller 5 is rotated in the direction a to advance the sheet material 9 in a direction c. After the sheet cutting by the cutter 6 subsequent to the image formation, the platen roller 5 is rotated in a direction b to return the leading end of the sheet material 9 to a predetermined stand-by position.

The cutter 6 is composed of a pair of blades 6*a*, 6*b*. The blade 6*a* is fixed to the main body, while the blade 6*b* is rotatable about a shaft 6*b*1 and is driven by drive means (not shown). In response to a cutting signal from the control unit, the blade 6*b* rotates in shearing motion with respect to the blade 6*a* thereby cutting the sheet material 9.

Said cutter 6 may be so constructed as to be driven by the motor 23, or by other drive means. Between said cutter 6 and platen roller 5, there are provided paired cutter guide members 6*c*, 6*d* for guiding the sheet material 9.

The recording head 8, to be driven by image signals from the control unit for forming an image on the sheet material 9, is supported on the cover 2 through a compression spring 8*a* and is made rotatable about a shaft 8*b* at an end.

In the present embodiment, the recording head 8 is composed of so-called thermal head having a plurality of heat-generating elements arranged on a face in contact with the sheet material, along the transversal direction thereof. In the image formation, the heat-generating elements 8*c* are selectively energized according to the image signals, and the image is formed on the sheet material 9 by the heat thus generated.

The sheet material 9 is composed for example of plain paper or thermal recording paper, of the appropriate characteristics matching the property of the recording means. In the present embodiment employing a thermal head 8, the sheet material 9 is composed of thermal recording paper wound on a core 9*b* as a roll 9*a*.

Because of said rolled form, the sheet material 9 develops curling, of which level depends on the diameter of the roll 9*a*. The curl developed at a large roll diameter has a small height H as shown in FIG. 4A, but the curl height H increases as the roll diameter decreases, eventually reaching a rounded curl state as shown in FIG. 4B. For this reason, there is required a curl correction mechanism functioning depending on the diameter of the roll 9*a*, for achieving effective curl correction.

The guide shaft 21, constituting the guide member, serves to correct the curl developed in the sheet material 9, in cooperation with the curl correction shaft 22 to be explained later.

Said guide shaft is rotatably mounted on an arm 27 which is rotatable about a shaft 26. Said shaft 26 is rotatably supported by the main body 1, and receives the power of the motor 23, through a slip clutch (frictional joint means) 28. Thus the power of the motor 23 is transmitted, through the gear 23*a* fixed to the motor 23, intermediate gear 24, gear 25 fixed to the platen roller 25 and an intermediate gear 29, to a gear 28*a* constituting the slip-clutch 28.

The transmission system from the motor 23 to the platen roller 5 and the transmission system from the motor 23 to the arm 27 are preferably so constructed that the rotating speed of the arm 27 is equal to or slightly faster than the rotating speed of the platen roller 5 or the advancing speed of the sheet material 9. The power transmitted from said motor 23 to the shaft 26 rotates said shaft 26 in the same direction as that of the platen roller 5.

The arm 27 need not necessarily be driven by the motor 23 for driving the platen roller 5, but can be driven by another motor.

The slip clutch 28 is composed of a clutch plate 28*b* fixed to the shaft 26, a friction member 28*c* in face contact with said clutch plate 28*b*, and a compression spring 28*d* mounted on an end of the shaft 26. The gear 28*a* is pressed to the clutch plate 28 across the friction member 28*c* by means of the compression spring 28*d*, and the power of the motor 23 is transmitted to the shaft 26 by the friction of contact. Consequently the power transmitted to the shaft 26 is determined by the frictional coefficient between the clutch plate 28*b* and the friction member 28*c*, and the biasing force of the compression spring 28*d*. Therefore, the biasing force of the spring 28*d* is preferably made adjustable, by a nut engaging on a screw thread formed on the end portion of the shaft 26.

A pair of arms 27 are fixed, at the approximate center thereof, to end portions of the shaft 26. The guide shaft 21 is rotatably supported on an end 27*a* of said arms 27 close to the roll 9*a*. The other end of the arms 27 constitute a contactor 27*b* for contacting the stopper 4*a* formed in a part of the roll holder 4 or a stopper 32 provided on a mounting member 30 to be explained later.

Said arms 27 are so shaped that, when rotated in a direction e, the guide shaft 21 is accommodated in a space defined above a wall of the roll holder 4 opposed to the platen roller 5 and below a guide plate 34.

The curl correction shaft 22 is rotatably mounted on a rotatable member (retracting means) 31, which is rotatably mounted on a mounting member 30 fixed to the cover 2.

Said mounting member 30 is composed of a guide portion 30*a* serving as a guide member for the sheet material 9 and as a stopper for limiting the rotary motion of the recording head 8 when the cover 2 is opened, brackets 30*b* extending downwards from both sides of said guide portion 30*a*, a stopper 30*c* for the rotatable member 31, formed at the upstream side of the guide portion 30*a* with respect to the advancing direction of the sheet material 9, a stopper 30*d* for the rotatable member 31, formed at the downstream side, and brackets 30*e* extending upwards from both sides of the guide portion 30*a*.

At the end of said brackets 30*b* there are provided stoppers 32 for contacting the contactors 27*b* of the arms 27 thereby limiting the rotatable range thereof. The brackets 30*e* rotatably supports the rotatable member 31 by means of a shaft 33.

Said rotatable member 31 is composed of axe-shaped plates rotatably mounted, in a direction f or g, on both ends portions of the shaft 33. The curl correction shaft 22 is rotatably mounted in the axe-shaped protruding part of said rotatable member 31. Consequently the rotatable member 31 always suspends vertically, by the weight thereof and the weight of the shaft 22, regardless of the opened angle of the cover 2.

The rotatable range of the member 31 is limited as an upper face 31*a* impinges on the stopper 30*c* of the mounting member 30 and a lateral face 31*b* impinges on the stopper 30*d*. Also a lower face 31*c* of the rotatable member 31 impinges on the shaft 26 when the cover 2 is closed. When the cover 2 is closed, the rotatable member 31 can assume, as shown in FIGS. 3A and 3B, a position in which the upper face 31*a* is in contact with the stopper 30*c* but the lower face 31*c* is separated from the shaft 26, or a position in which the upper face 31*a* is separated from the stopper 30*c* but the lower face 31*c* is in contact with the shaft 26.

Figure 9:
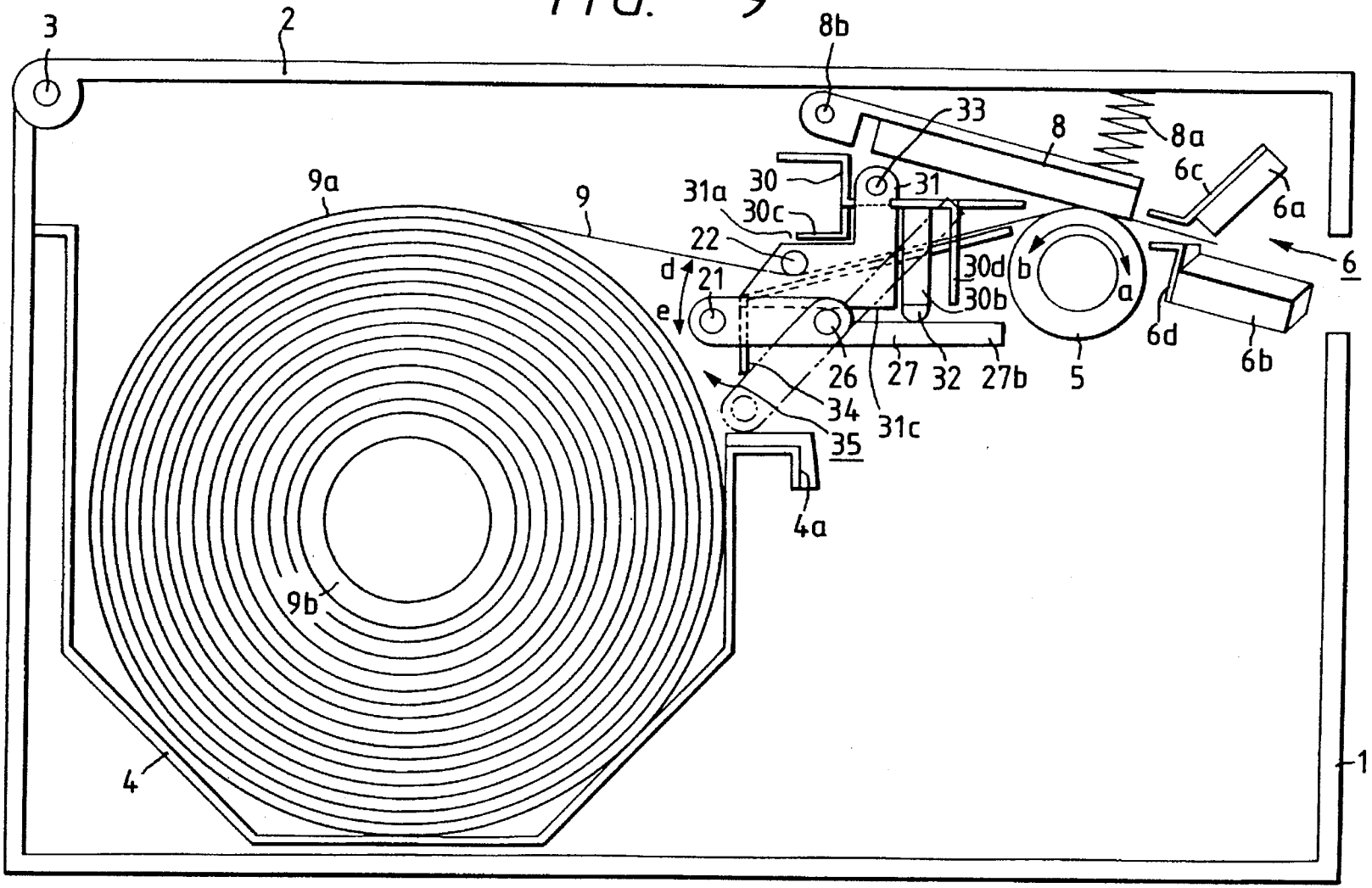

When the cover 2 is opened, the upper face 31*a* of the rotatable member 31 is separated from the stopper 30*c* of the mounting member 30 by said opening, or is already separated from the stopper 30*c* even prior to said opening, and the lower face 31*c* of the rotatable member 31 moves in a direction g along the shaft 26. When the cover 2 is closed, said lower face 31*c* moves in a direction f along the shaft 26, whereby the position of the rotatable member 31 is limited by the stopper 30*c* and the shaft 26. Consequently, when the cover 2 is closed as shown in FIG. 2A, 2B or 9, the rotatable member 31 is either in a position in which the upper face 31*a* is in contact with the stopper 30*c* and the lower face 31*c* is separated from the shaft 26, or in a position in which the upper face 31*a* is separated from the stopper 30*c* and the lower face 31*c* is in contact with the shaft 26.

The curl correction shaft 22 is provided at a position at the upstream side of the platen roller 5 with respect to the advancing direction of the sheet material 9 and not providing an excessively large introduction angle of the sheet material 9 into the platen roller 5.

The guide plate opposed to the shaft 22 extends at an end close to the platen roller 5 and at the other end close to the upright wall of the roller holder 4, and serves to guide the sheet material 9 from the roll 9*a* to the platen roller 5.

In the following there will be explained the principle of curl correction in the above-explained recording apparatus. FIG. 2A shows the curl correction in case the roll diameter is large, and FIG. 2B shows that in case of small roll diameter.

The motor 23 rotates the platen roller 5 in a direction a, thereby advancing the sheet material 9 in a direction c. At the same time the power of the motor 23 is transmitted to the slip clutch 28, thereby rotating the arms 27, fixed on the shaft 26, in a direction d and bringing the guide shaft 21 into contact with the sheet material 9. Thus the transport path of the sheet material 9 is defined by the roll 9*a*, guide shaft 21, curl correction shaft 22 and platen roller 5, wherein the sheet material 9 wrappes the shaft 21 in the same direction as the winding direction of the roll 9*a* but the shaft 22 in the opposite direction. The curl of the sheet material 9 is corrected by the wrapping on the curl correction shaft 22.

By the contact friction between the roll holder 4 and the roll 9*a* loaded therein, the sheet material 9 is subjected to a tension F, proportional to the weight of the roll 9*a*.

In FIG. 2A, the sheet material 9 is subjected to a tension $F_1$, corresponding to the weight $G_1$ of the roll 9*a*, before and after the guide shaft 21 and the curl correction shaft 22. When the shaft 21 is positioned in a direction d, the upper face 31*a* of the rotatable member 31 is brought into contact with the stopper 30*c* by the synthesized tensions $F_1$ before and after the curl correction shaft 22, thereby defining the position of said shaft 22. At the same time the wrapping amount of the sheet material 9 on the guide shaft 21, whereby the resistance by said synthesized tension $F_1$ to the rotating force of the arms 27 (torque transmitted by the slip clutch 28) increases. Thus the rotation of said arms 27 is stopped at a position where the rotating force thereof balances with said synthesized force. In this state slippage is generated between the clutch plate 28*b* and the friction member 28*c* of the slip clutch 28.

When the rotating force on the arms 27 balances with the tension $F_1$ on the sheet material 9, said sheet material 9 moves from the shaft 21 to 22 with an angle θ1, and then proceeds to the platen roller 5.

When the roll 9*a* is reduced in diameter, with a weight $G_2$ smaller than G1, as shown in FIG. 2B, the tension $F_2$ on the sheet becomes smaller than $F_1$. Consequently, the resistance on the guide shaft 21 by said tension is reduced, and the arms 27 further rotates in the direction d, from the position under the tension $F_1$. The arms 27 are stopped either at a position where the rotating force therefor balances with said resistance, or at a position where the contactors 27*b* engages with the stopper 4*a* if the rotating force is larger. The curl correction shaft 22 is lifted by the tension of the sheet material 9, and is stopped where the upper face 31*a* of the rotatable member 31 engages with the stopper 30*c*. In this state the angle θ2 of the sheet material 9 before and after the shaft 22 is smaller than θ1. Consequently, the wrapping amount of the sheet 9 on the curl correction shaft 22 is small for a large roll diameter, and increases as the roll diameter decreases.

FIGS. 4A and 4B show the curl developed in the sheet material 9, wherein H indicates the curl height. FIG. 5 shows the curl height H of the sheet material 9 of a predetermined length, cut from the roll 9*a* with and without curl correction.

In the present experiment, the sheet material 9 was composed of thermal recording paper of a width of 210 mm (corresponding to A4 size) and a length of 100 m, wound as a roll 9*a* on a core 9*b* of a diameter of 1 inch (25.4 mm). The initial roll diameter was 96 mm. The rotating force of the arms 27 was selected as 1 kg, and the diameter of the curl correction shaft 22 was 4 mm. The angle θ of the sheet material 9 before and after the shaft 22 was selected as 130°–30°. The sheet material 9 was cut at a length of 297 mm corresponding to A4 size.

In FIG. 5, white triangles indicate sheets without curl correction, showing curl as indicated in FIG. 4A. White circles indicate those with curl correction, showing curl as indicated in FIG. 4A. Black triangles indicate sheets without curl correction, showing curl as illustrated in FIG. 4B.

As will be apparent from FIG. 5, the height H of the curl developed in the sheet material 9 becomes smaller as the diameter of the roll 9*a* increases, and vice versa. A fully rounded curl is observed in the sheet material 9 when the diameter of the roll 9*a* becomes smaller than about 40 mm.

On the other hand, the sheet material 9 corrected by the curl correction mechanism of the present embodiment is almost free from curl development, and the measured curl height H is almost constant. This fact indicates that appropriate correction was applied to the sheet materials 9 of different curl heights H depending on the roll diameter.

As explained in the foregoing, the curl correction mechanism of the present embodiment defines the transport path of the sheet material 9 by the guide shaft 21 mounting the arms 27, depending on the balance between the tension F on the sheet 9 and the rotating force on said arms 27, thereby varying the angle of the sheet material 9 before and after the curl correction shaft 22 and correcting the curl of said sheet material 9 according to the tension F applied thereon.

Figure 6A:
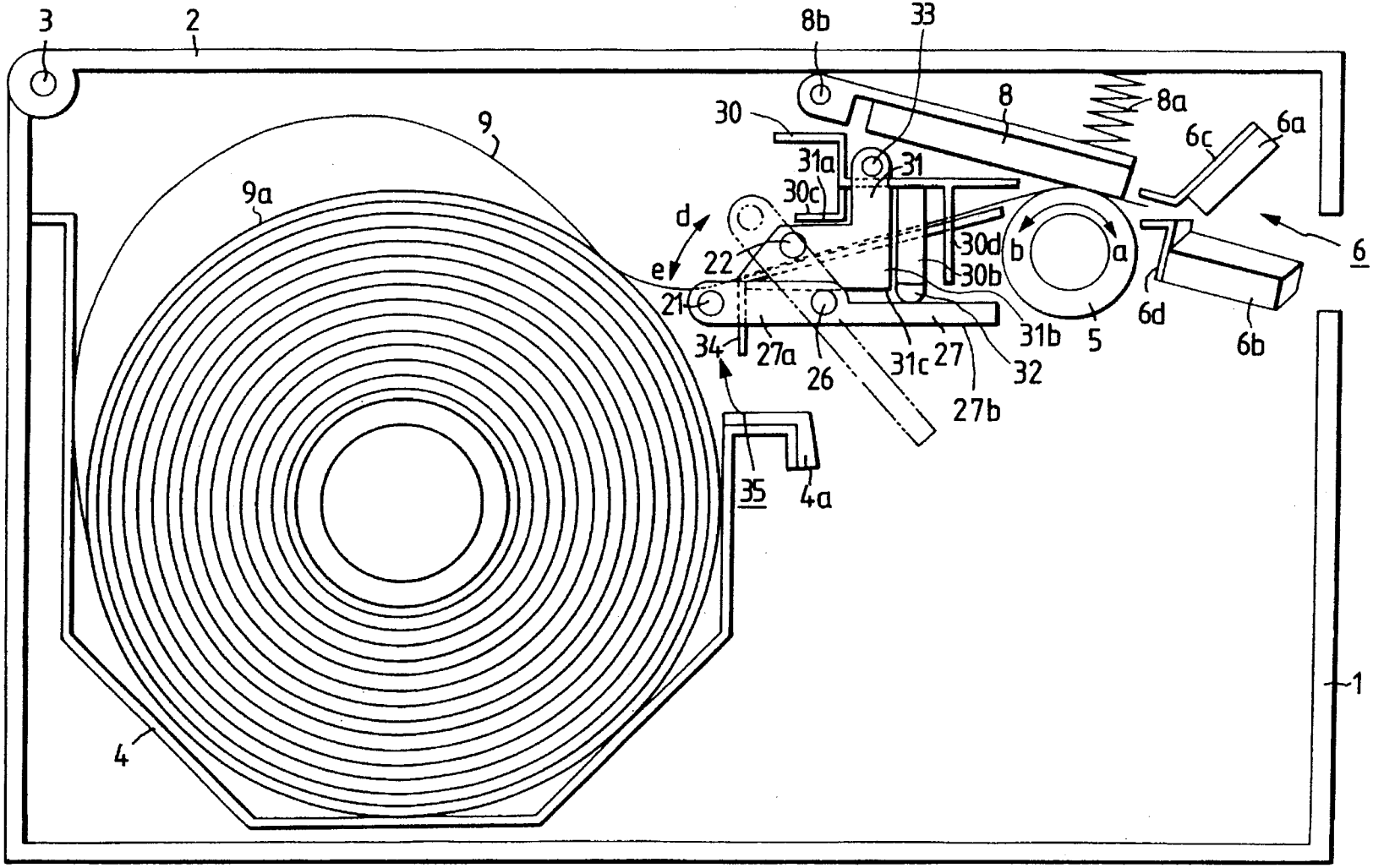
FIGS. 6A and 6B are views showing state when the sheet material is pulled back.
Figure 6B:
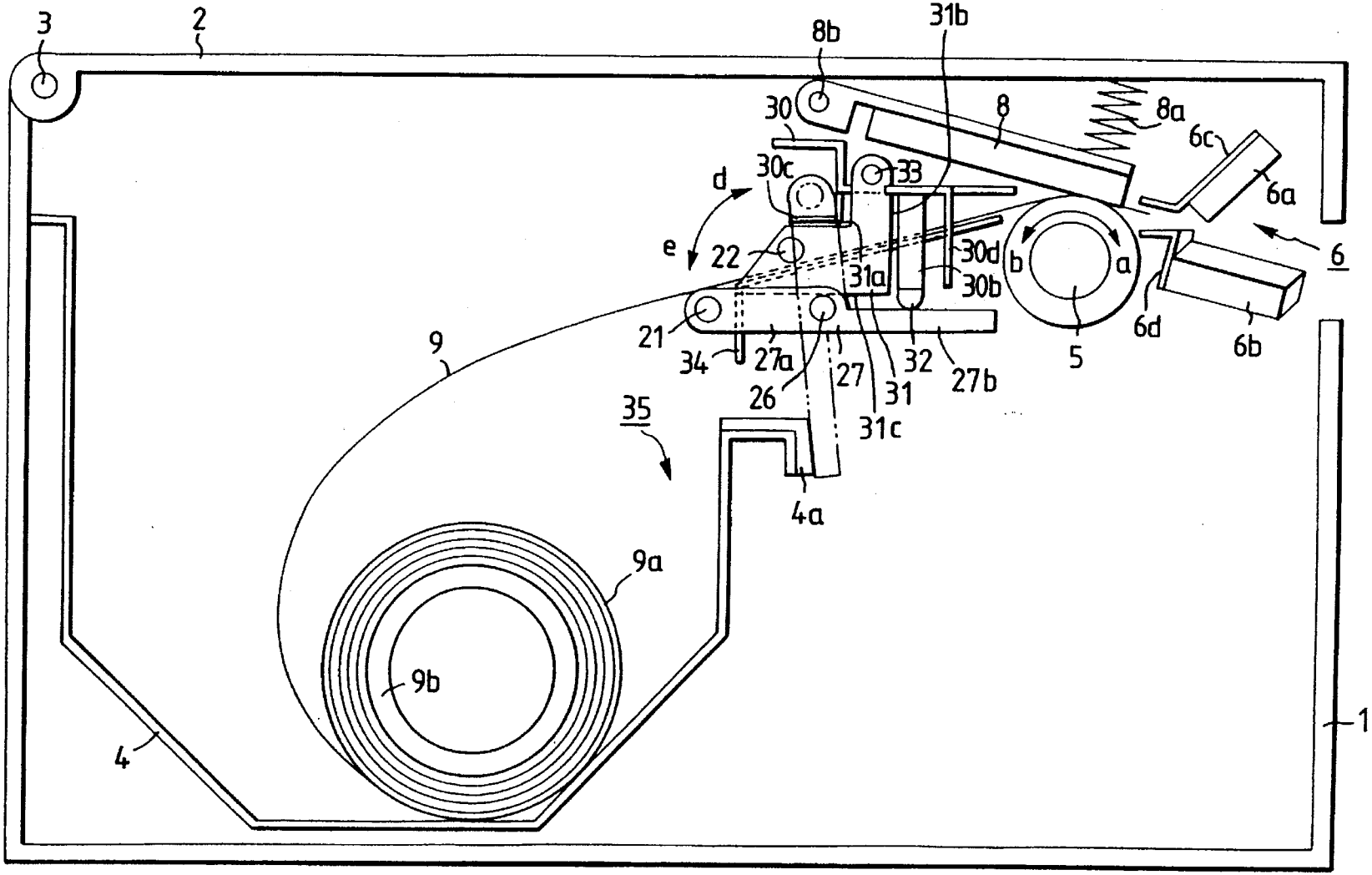

After the image recording of a page and the cutting of the sheet material 9 with the cutter 6 in the above-explained mechanism, the motor 23 is activated to rotate the platen roller 5 in a direction b in order to bring back the leading end of the remaining sheet material 9 toward the recording position of the recording head 8, whereby the power of the motor 23 is at the same time transmitted, through the slip clutch 28, to the shaft 26, thereby rotating the arms 27 in a direction e, until the contactor 27*b* impinge on the stopper 32. In this state, the guide shaft 21 is positioned on the extention of the guide plate 34 as shown in FIGS. 6A and 6B, closing a space 35 defined by the roll holder 4 and the roll 9*a*. Also the slip clutch 28 shows slippage between 10 the clutch plate 28*b* and the friction member 28*c*.

Also since the curl correction shaft 22 is disengaged from the sheet material 9, the rotatable member 31 descends by the weight thereof to a position where the lower face 31*c* of the rotatable member 31 is contact with the shaft 26.

The rotation of the arms 27 in the direction e releases the guide shaft 21 from the contact with the sheet material, whereby the guide shaft 21 no longer defines the transport path of the sheet material 9, thus generating a slack in the sheet material 9 between the roll 9*a* and the platen roller 5. Said slack portion of the sheet material 9 extends along the guide plate 34 positioned opposite to the shaft 22, and is supported by the shaft 21 positioned on the extention of the guide plate 34. Consequently, the sheet material 9 does not enter the space 35, but is accommodated in a space between the roll 9*a* and the cover 2, showing a mild curve as illustrated. Thus the sheet material does not develop local folds.

When the diameter of the roll 9*a* decreases as shown in FIG. 2B, the guide shaft 21 moves to above the curl correction shaft 22 by the rotation of the arms 27 in a direction d. The shafts 21, 22 mutually interfere if the cover 2 is opened in this state, for example for removing the sheet jamming developed in the apparatus.

In the present embodiment, the cover 2 can be easily opened even when the guide shaft 21 and the curl correction shaft 22 mutually interfere, because the shaft 22 is mounted on the rotatable member 31 which is rotatably mounted on the mounting member 30 and can be retracted at the opening of the cover 2.

When the cover 2 is closed, the position of the rotatable member 31 is limited as the upper face 31*a* thereof is in contact with the stopper 30*c* as explained before. When the cover 2 is opened, the upper face 31*a* or the rotatable member 31 is released from the stopper 30*c*, whereby the lower face 31*c* rotates along the shaft 26. Then, when the cover 2 is further opened as shown in FIG. 7, the lower face 31*c* of the rotatable member 31 is released from the shaft 26, whereby the rotatable member 31 is rendered rotatable in a direction f or g about the shaft 33, in a range from a position where the upper face 31*a* is in contact with the stopper 30*c* to a position where the lateral face 31*b* is in contact with the stopper 30*c*.

Figure 7:
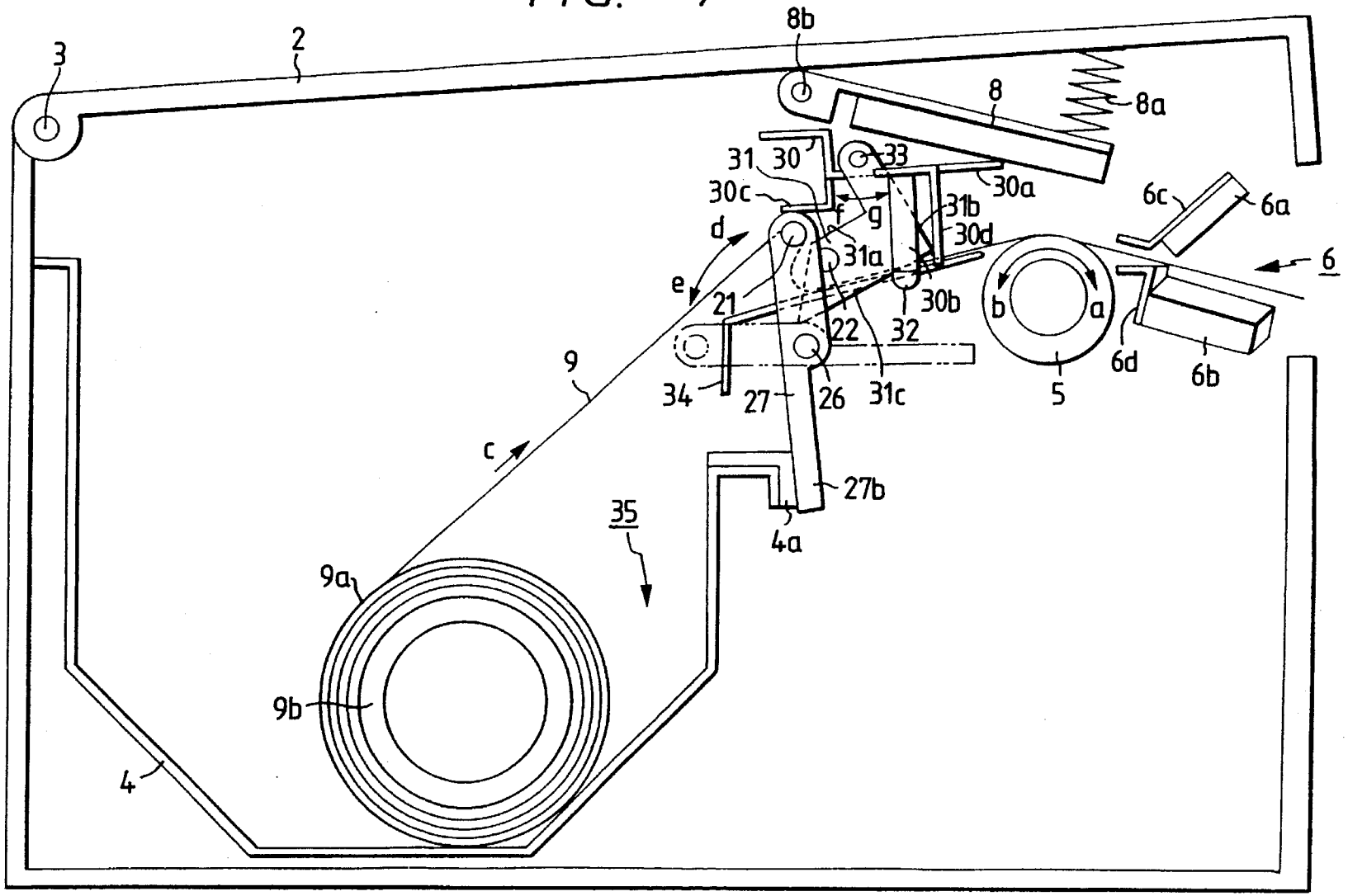
FIG. 7 is a view of a state of opening the cover.

Consequently, when the cover 2 is opened in a state of mutual interference of the guide shaft 21 and the curl correction shaft 22 as shown in FIG. 2B, the rotatable member 31 rotates, as shown in FIG. 7, in a direction g, keeping the lower face 31*c* in contact with the shaft 26, by means of the weight of said member 31 and that of the shaft 22. Said rotation of the rotatable member 31 in the direction g eliminates the mutual interference of the shafts 21 and 22, thereby enabling easy opening of the cover 2.

On the other hand, when the cover 2 is closed with the arms 27 in a position shown in FIG. 7, the rotatable member 31 rotates with respect to the cover 2 by means of the weight of said member 31 and that of the curl correction shaft 22, but the lower face 31*c* of the rotatable member 31 is positioned above the shaft 26 while the upper face 31*a* is positioned below the guide shaft 21, because the lateral face 31*b* of said member 31 is in contact with the stopper 30*d* as shown in FIG. 7. When the cover 2 is further closed, the lower face 31*c* of the rotatable member 31 is brought into contact with the shaft 26 and rotates along said shaft 26, so that the cover 2 can be closed without the interference of the rotatable member 31 and the guide shaft 21.

In the following there will be explained the image forming operation on the sheet material 9 by the recording apparatus equipped with the above-explained curl correction mechanism.

Figure 8:
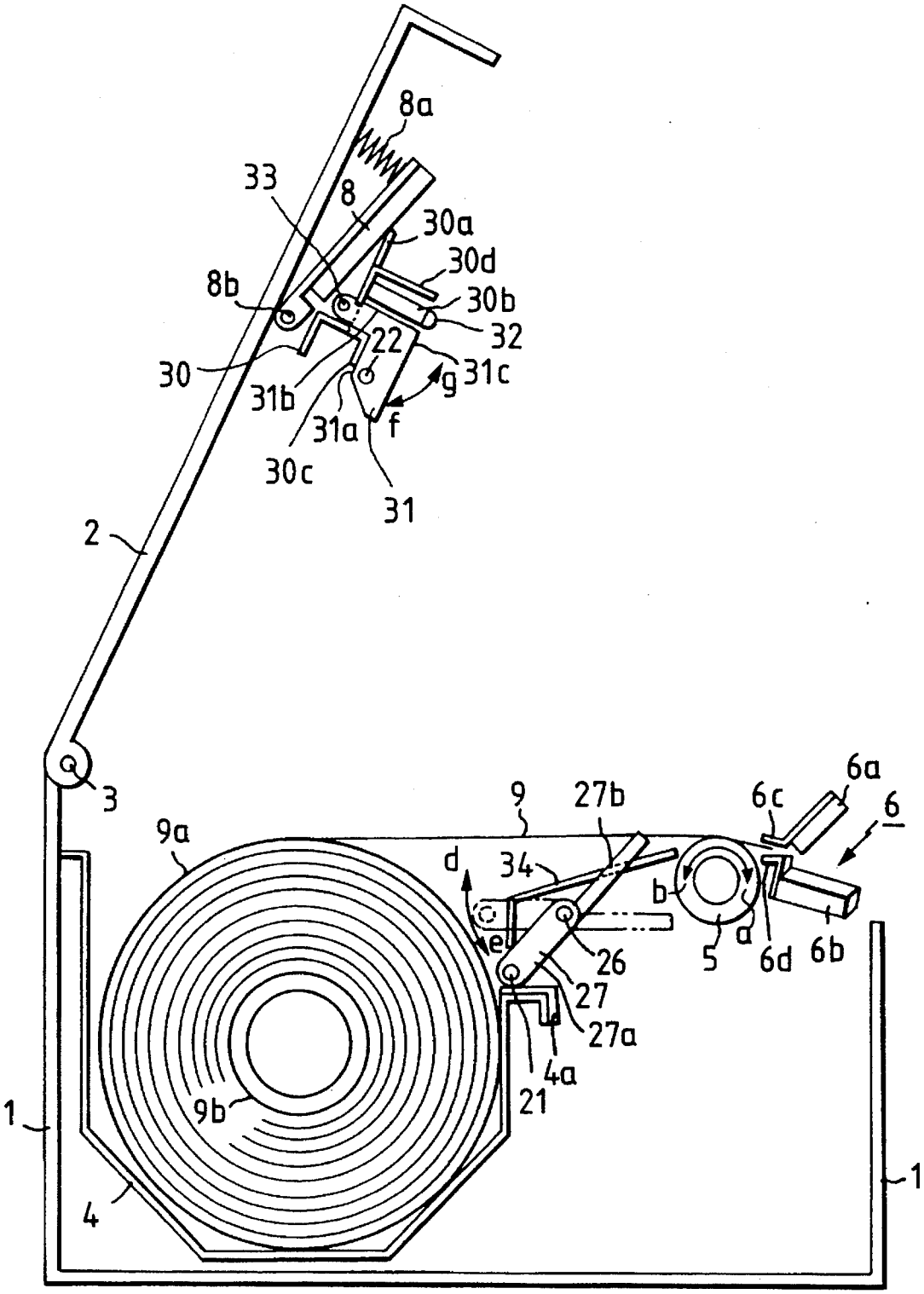
FIGS. 8 and 9 are views showing the loading of a roll.

At first the roll 9*a* is loaded in the roll holder 4 by opening the cover 2 as shown in FIG. 8. Due to the opening of the cover 2, the contactors 27*b* of the arms 27 are released from the stopper 32, whereby the arms 27 are no longer limited in rotation in the direction e. In this state as shown in FIG. 8, the arms 27 maintain a position indicated by a double-dotted chain line. If the roll 9*a* touches the guide shaft 21 at the loading, said shaft 21 is rotated in the direction e, by the weight of the roll 9*a*, to a gap between the roll holder 4 and the guide plate 34. Consequently, the guide shaft 21 does not unfavorably affect the loading of the roll 9*a*, whereby the entire apparatus can be made compact.

Then the sheet material 9 is pulled out from the roll 9*a*, and is threaded through the platen roller 5 and between the cutter guides 6*c*, 6*d*. Then the cover 2 is closed as shown in FIG. 9 whereby the stopper 32 is brought into contact with the contactors 27*b*, thus rotating the arms 27 from said chain-lined position in the direction d to the initial stand-by position. Also the rotatable member 31 is brought to the initial position in which the lower face 31*c* is in contact with the shaft 26, so that a gap is maintained between the upper face 31*a* and the stopper 30*c*. Said gap is provided for ensuring an over-stroke of the cover 2 in engaging the same with the main body 1.

As explained in the foregoing, the present embodiment allows to dispense with the threading of the sheet material under the curl correction shaft, whereby the setting of the sheet material is facilitated and the entire apparatus can be compactized.

When the recording signal is sent from the control unit (not shown), the motor 23 is activated to rotate the platen roller 5 in the direction a as shown in FIGS. 2A and 2B, thereby advancing the sheet material 9 in the direction c. At the same time the arms 27 rotate in the direction d, and stops at a position balanced with the tension F on the sheet material 9. Also the rotatable member 31 rotates in the direction f, and stops at a position where the upper face 31*a* thereof is in contact with the stopper 30*c*. In this state, the transport path of the sheet material 9 is defined by the guide shaft 21 and the curl correction shaft 22. Thus the sheet material 9 wraps the shaft 22 with an angle corresponding to the tension F on said sheet material, whereby the curl is corrected.

On the other hand, the recording head 8 is given image signals in synchronization with the transportation of the sheet material 9 to activate the heat-generating elements 8*c*, thereby forming an image on the sheet material 9.

After image formation, the sheet material 9 continues to be advanced in the direction c. When the rear end of the image formed on the sheet material 9 reaches the cutter 6, said cutter 6 is energized to cut the sheet material 9. The cut sheet 9 is then discharged from the main body 1.

After said cutting, the platen roller 5 is rotated in the direction b by the motor 23 as shown in FIGS. 6A and 6B, and the arms 27 simultaneously rotate in the direction e. Since the rotating speed of the arms 27 is equal to or faster than the transporting speed of the sheet material 9 by the platen roller 5, the guide shaft 21 is released from the sheet material 9 and is retracted to the initial position where the contactors 27*b* of the arms 27 are in contact with the stopper 32. Also the rotatable member 31 descends by the weight thereof, and stops at the initial position where the lower face 31*c* is in contact with the shaft 26. The sheet material 9 is pulled back by the rotation of the platen roller 5 in the direction b, and the motor 23 is stopped and enters the stand-by state when the leading end of the sheet material 9 reaches a predetermined stand-by position.

When the next recording signal is sent from the control unit in said stand-by state, the motor 23 rotates the platen roller 5 in the direction a as shown in FIGS. 2A and 2B, and the arms 27 rotate simultaneously in the direction d. Also the rotatable member 31 rotates and stops at a position where the upper face 31*a* is in contact with the stopper 30*c*. In this operation, at first transported is the slack of the sheet material 9 pulled back by the rotation of the platen roller 5 in the direction b after the preceding image recording. While said slack is transported, the arms 27 rotate to limit the transport path of the sheet material 9, whereby the curl thereof can be appropriately corrected.

Figure 10:
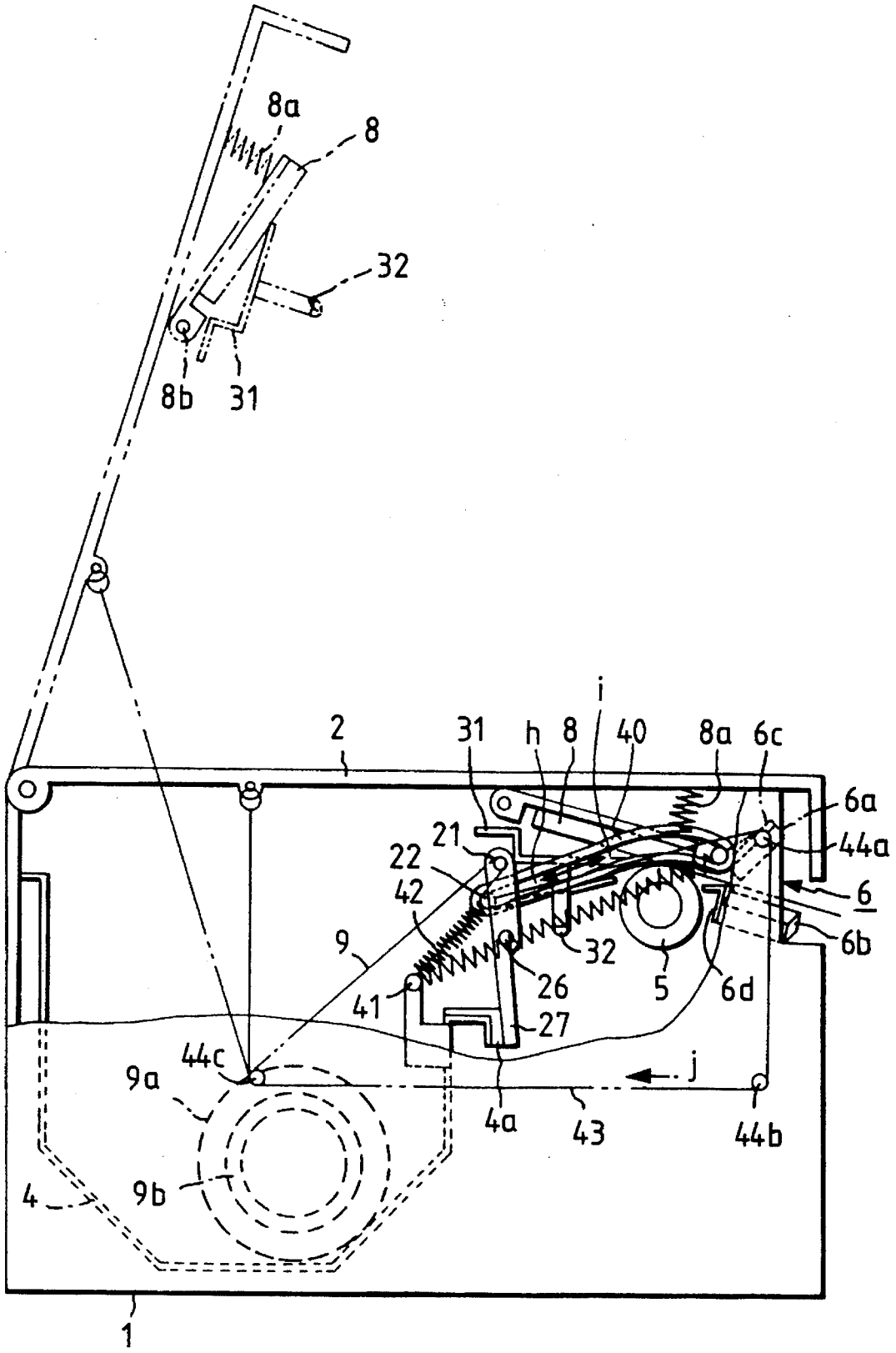
FIG. 10 is a schematic view of another embodiment.

FIG. 10 shows another embodiment of the curl correction mechanism in which the curl correction shaft 22 can be moved by the opening and closing motion of the cover 2. In FIG. 10, same or equivalent components as those in the foregoing first embodiment are represented by same numbers, and will not be explained further.

On both sides of the main body 1, there are fixed rail members 40. The curl correction shaft 22 is supported at both ends by said rail members 40, and is made movable along said rail members 40. Tension springs 42 are provided between both ends of the shaft 22 and a pin 41 provided in the main body 1. Also on each end of the shaft 22 there is fixed a wire 43 which goes around pins 44*a*–44*c* provided in the main body 1 and is connected at an end to the cover 2.

Consequently, the curl correction shaft 22 is constantly biased, by the tension springs 42, in a direction h along the rail members 40, and is maintained in contact with the end of said rail members 40 when the cover 2 is closed. When the cover 2 is opened, the wires 43 are pulled in a direction j, whereby the shaft 22 moves in a direction i along the rail members 40.

In the present embodiment, as explained above, the curl correction shaft 22 is movable from the initial position along the rail members 40, by opening of the cover 2. Consequently, even when the cover 2 is opened in a state of mutual interference of the guide shaft 21 and the curl correction shaft 22 as indicated by solid lines in FIG. 10, the shaft 22 can be retracted from the initial position, so that the cover 2 can be easily opened without interference of said shaft 22 with the guide shaft 21.

In the above-explained structure, the curl correction for the sheet material 9 can be achieved as in the first embodiment explained above.

Figure 11:
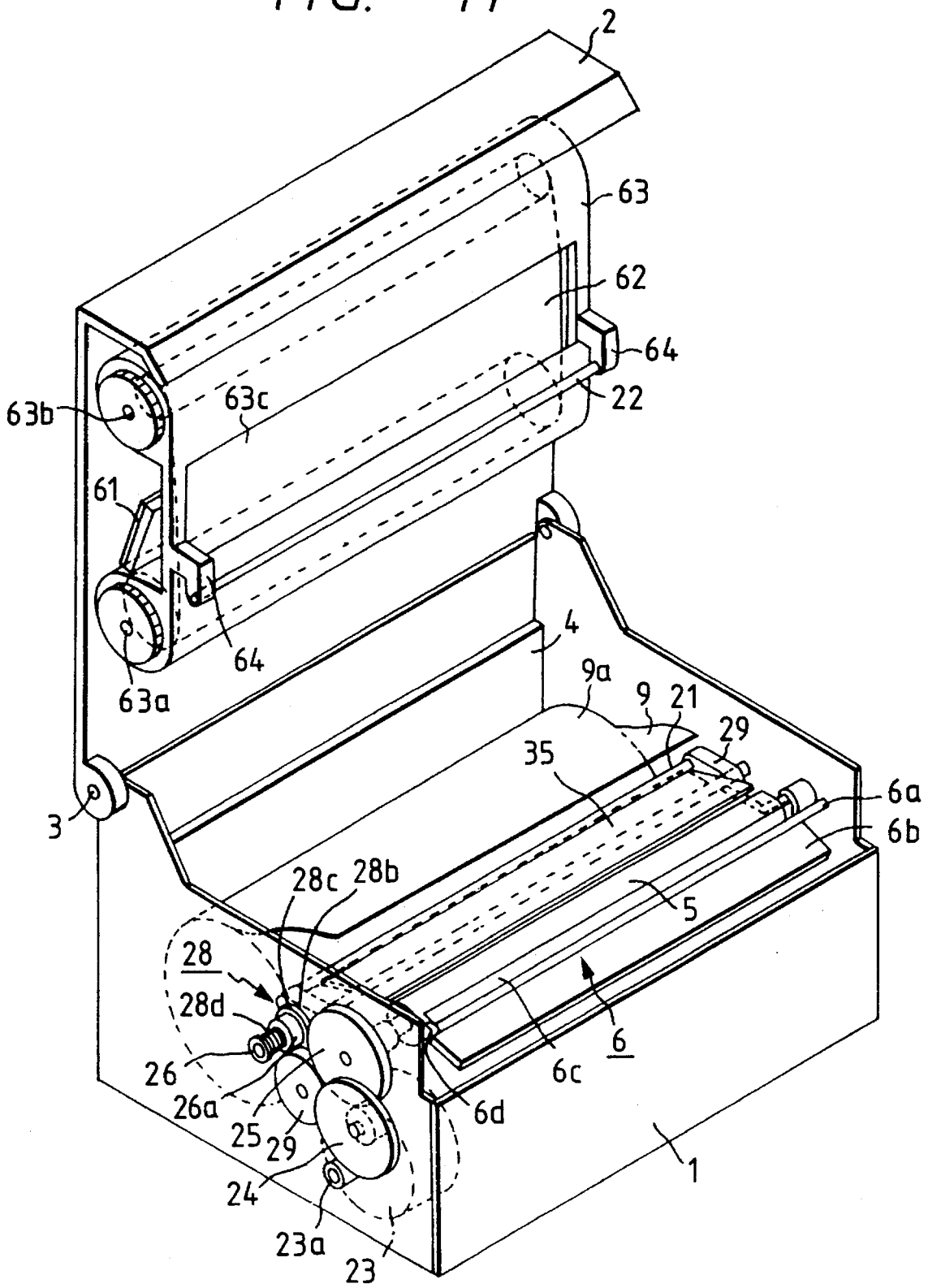
FIGS. 11, 12 and 13 are schematic views of still another embodiment.
Figure 12:
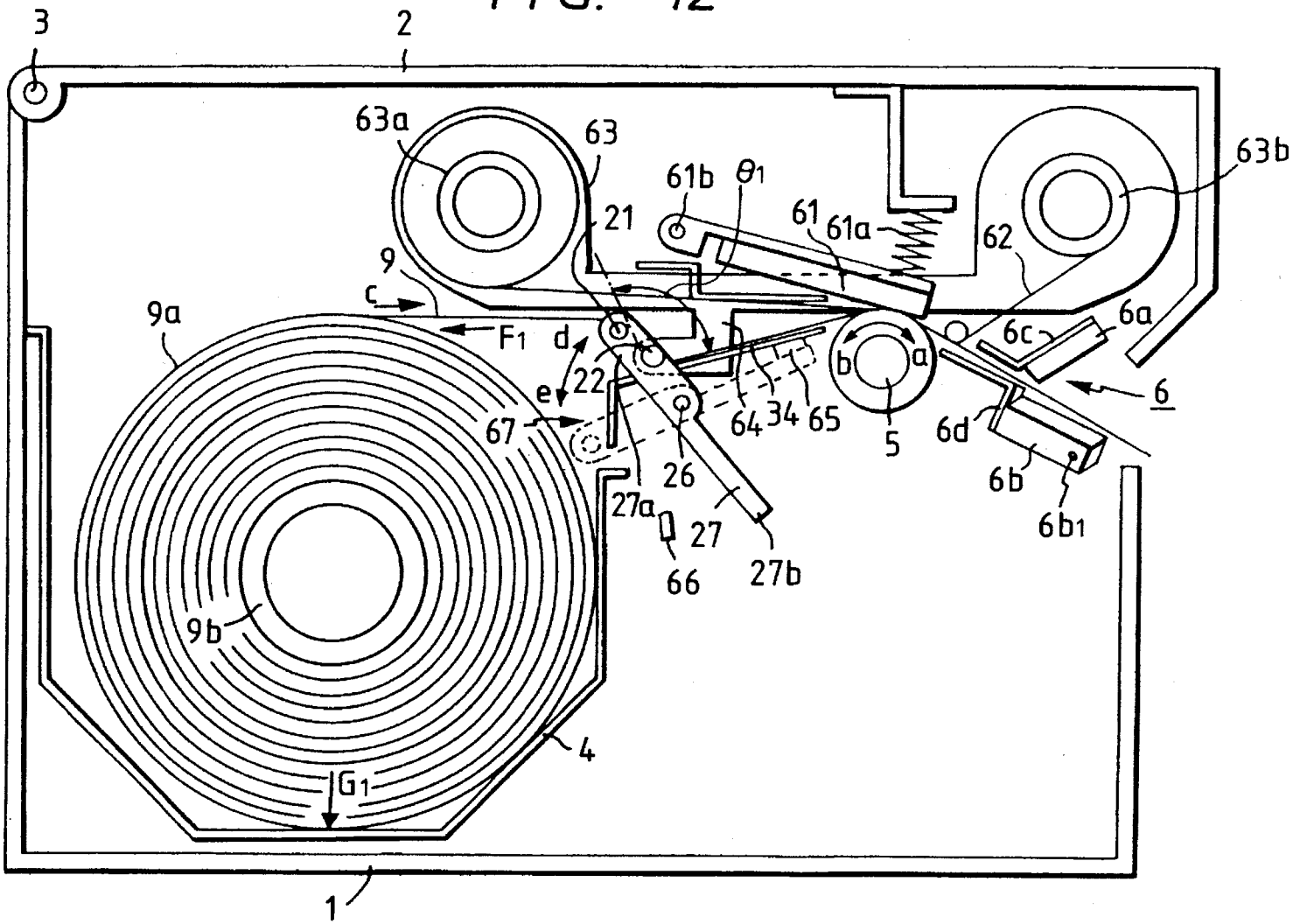
Figure 13:
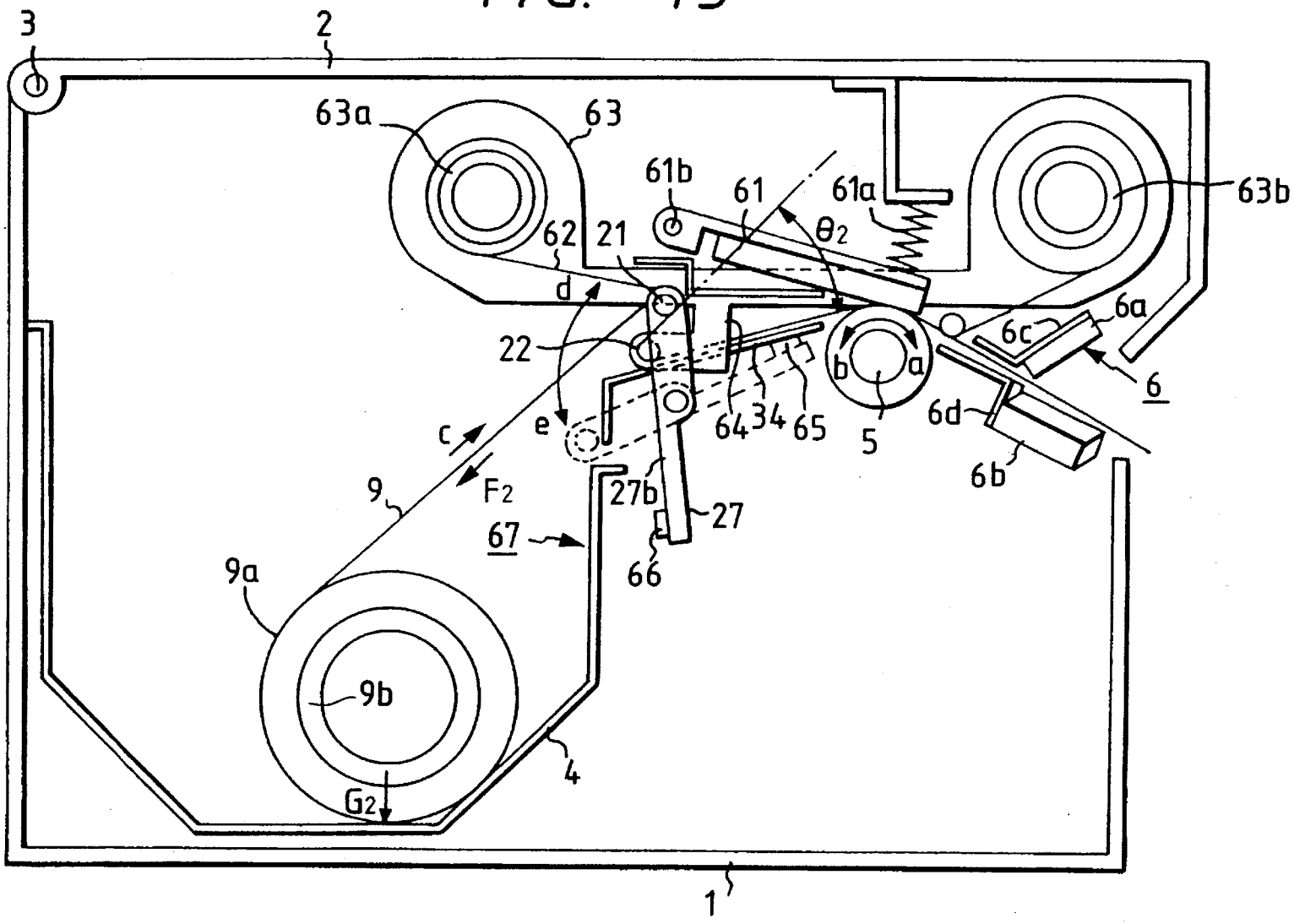

In the following there will be explained still another embodiment with reference to FIG. 11 which is a schematic perspective view of a recording apparatus, and FIGS. 12 and 13 which are views showing the principle of curl correction, and FIGS. 14 and 15 which are views for explaining curl of the sheet and result of the experiment, wherein same components as those in the foregoing embodiments are represented by same numbers and will not be explained further.

On the cover 2, a recording head 61 is mounted by means of a compression spring 61*a*, in a position opposed to the platen roller 5. Also in a predetermined position of the cover 2, there is detachably mounted a cartridge 63 housing an ink sheet 62 constituting a transfer medium, by means of engaging means (not shown). On said cartridge 63 there is rotatably mounted the curl correction shaft 22.

Said recording head 61 is maintained in pressure contact with the platen roller 5, across the recording sheet 9 and the ink sheet 62, and an image is formed on the recording sheet 9 by driving the recording head 61 according to image signals from a control unit (not shown), while the recording sheet 9 is advanced by the platen roller 5. After image formation, the recording sheet 9 is cut by the cutter 6 and discharged from the apparatus.

In the present embodiment, the recording sheet 9 is advanced by pinching said sheet 9 and the ink sheet 62 between said platen roller and the recording head 61. Said recording head 61 is composed of so-called thermal head having a plurality of heat-generating elements (not shown) arranged on a face in contact with the ink sheet 62, along the transversal direction thereof. At the image formation, the heat-generating elements are selectively activated according to the image signals to generate heat, whereby the ink coated on the ink sheet 62 is transferred, by fusion or sublimation, to the recording sheet 9 to form an image thereon.

The recording sheet 9 is composed of continuous plain paper or plastic film of an appropriate quality matching the structure of the recording means. In the present embodiment employing the thermal head 61, the recording sheet 9 is composed of plain paper wound as a roll 9*a* on a core 9*b*.

Ends of arms 27 constitute contactors 27*b* for contacting stoppers 65, 66 provided on the main body 1.

The curl correction shaft 22 is rotatably mounted on mounting members 64 protruding from the cartridge 63. When the cover 2 is closed, said shaft 22 is maintained in a constant position in the main body 1, since it is mounted on the mounting members 64 protruding from the cartridge 63.

The ink sheet 62 constituting the transfer medium is formed by coating a substrate such as a polyethylene terephthalate film with heat-fusible ink.

The cartridge 63 is mounted detachably on the cover 2 by engaging means (not shown), and houses the ink sheet 62 extended between a feed roll 63*a* and a take-up roll 63*b*. The cartridge 63 is provided, in a position opposed to the platen roller 5, with a window 63*c* in which the ink sheet 62 is exposed. When the cover 2 is closed, the recording head 61 is maintained in contact with the platen roller 5 through said window 63*c*.

On the lower face of said cartridge 63, and at the upstream side of the platen roller 5 with respect to the transport direction of the recording sheet 9, there are formed protruding mount members 64 rotatably supporting the curl correction shaft 22. Opposed to the shaft 22 there is provided a guide plate 34, of which an end extends close to the platen roller 5 while the other end extends close to a vertical wall of the roll holder 4. Said guide plate 34 serves to guide the recording sheet 9 from the roll 9*a* to the platen roller 5.

In the following there will be explained the image formation on the recording sheet 9 by the above-explained recording apparatus.

At first, in loading the roll 9*a* in the main body 1, the cover 2 is opened and the roll 9*a* is loaded in the roll holder 4. At the same time the recording sheet 9 is pulled out from the roll 9*a* and is threaded over the platen roller 5 and between the cutter guides 6*c* and 6*d*.

The curl correction shaft 22 moves with the cover 2, as it is mounted on the cartridge 63 on the cover 2. Consequently the roll holder 4, guide shaft 21, guide plate 34 and platen roller 5 provided in the main body 1 are exposed, and it is not necessary to thread the recording sheet 9 under the curl correction shaft. Thus the roll 9*a* can be easily set.

When a recording signal is sent from the control unit (not shown), the motor 23 rotates the platen roller 5 in a direction a, thereby advancing the recording sheet 9 and the ink sheet 62 in a direction c. Simultaneously, the arms 27 rotate in a direction d and stop at a position balanced with the tension F on the recording sheet 9. In this state, the transport path of the recording sheet 9 is defined by the guide shaft 21 and the curl correction shaft 22, and the recording sheet wraps the shaft 22 with an angle θ corresponding to the tension F on said recording sheet 9, and is subjected to curl correction.

The recording head 61 receives the image signals in synchronization with the transportation of the recording sheet 9 to heat the ink sheet 62 by heat generated by the heat-generating elements, whereby the ink coated on the ink sheet 62 is transferred, by fusion or sublimation, to the recording sheet 9 to form an image thereon.

After the image formation, the recording sheet 9 continues to be advanced in the direction c, and, when the rear end of the image formed on said sheet 9 reaches the cutter 6, said cutter 6 is energized to cut the recording sheet 9 which is subsequently discharged from the main body 1.

After said cutting, the platen roller 5 is rotated in the direction b by the motor, and the arms 27 are simultaneously rotated in the direction e. Since the rotating speed of the arms 27 is equal to or larger than the transport speed of the recording sheet 9 by the platen roller 5, the guide shaft 21 is rapidly released from the recording sheet 9 and is retracted into the initial position in a space 67. When the leading end of the recording sheet 9 pulled back from the cutter 6 by the rotation of the platen roller 5 in the direction b, the motor 23 is stopped and enters the stand-by state.

When a next recording signal is sent from the control unit in said stand-by state, the platen roller 5 is rotated in the direction a by the motor 23, and the arms 27 are simultaneously rotated in the direction d. In this operation, at first transported is the slack of the recording sheet 9 pulled back by the rotation of the platen roller 5 in the direction b after the preceding recording. During the transportation of said slack, the arms 27 rotate to define the transport path of the recording sheet 9, whereby the curl of the recording sheet 9 can be appropriately corrected.

In the foregoing embodiments, the rolled sheet material is placed on the roll holder, but the present invention is likewise applicable to a rolled sheet material rotatably supported by a shaft inserted into the center of said roll, if the sheet pulling resistance decreases with the decrease of the sheet material.

Also in the foregoing embodiment the curl correction is achieved by a curl correction shaft and a guide shaft of both cylindrical shape, but either or both may be replaced by a guide plate or guide plates.

In the following there will be explained still another embodiment of the present invention applied to a facsimile apparatus, with reference to FIGS. 14 and 15 which are perspective views of a recording system of the facsimile apparatus and FIG. 16 which is a cross-sectional view of the entire facsimile apparatus.

Figure 16:
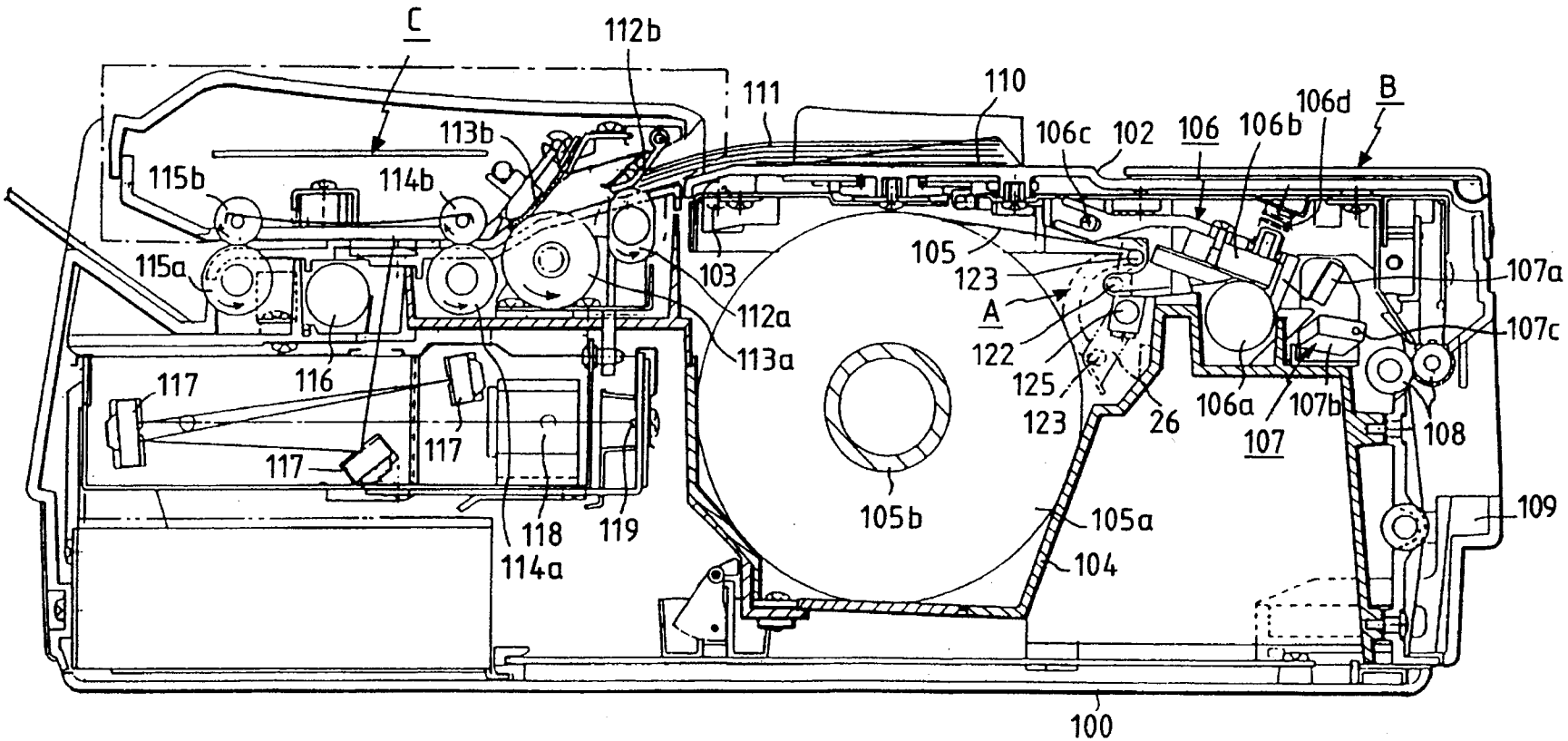
FIG. 16 is a cross-sectional view of the entire facsimile apparatus.

As shown in FIG. 16, the facsimile apparatus is composed of a recording system B equipped with a curl correction mechanism, and an original reading system C.

Referring to FIG. 16, the recording system B has a main body 100 and a cover 102 articulated thereto by a shaft 103, wherein said cover 102 can engage with the main body 100 by a clock mechanism (not shown). In a roll holder 104 formed in the rear part of the recording system, there is loaded a roll 105*a* of a thermal recording sheet 105. Said sheet material 105 is advanced by the rotation of a platen roller 106*a* constituting transport means, and is subjected to curl correction by being bent, in passing the curl correction mechanism A, in a direction opposite to the direction of curl.

After curl correction, the sheet material 105 is subjected to image formation by recording means 106, and the sheet material 105 after image formation is cut by a cutter 107 and discharged by discharge rollers 108 onto a discharge stacker 109.

In the original reading system C, plural original documents 111 are set on an original stacker 110 formed on the upper face of said cover 102. In the reading operation, several lowermost sheets of said plural originals 111 are advanced by a preliminary transport roller 111*a* and a pressure member 112*b*, and then are separated and advanced one by one by a separating roller 113*a* and a pressure member 113*b* in contact therewith. The separated original 111 is illuminated by a light source 116 while it is transported by paired transport rollers 114*a*, 114*b*; 115*a*, 115*b*, and the reflected light is introduced, through a mirror 117 and a lens 118, into a photoelectric converting device 119 such as a CCD for conversion into electrical signals. Said signals are transmitted to the recording system B in case of the copy mode, or transmitted to the recording system of another apparatus in the facsimile mode.

In the following explained is the structure of the recording system B equipped with the curl correction mechanism A.

The roll holder 104 is open on the stop and is positioned in the rear part of the main body 100 of the recording system. The sheet roll 105*a* is loaded in said roll holder 104, and frictional resistance is generated by the contact of the external periphery of said roll 105*a* with the internal wall of the holder 104. Said frictional resistance is large when the roll 105*a* is large in diameter and heavy, but decreases as the roll 105*a* becomes lighter in weight by the consumption of the sheet 105. The tension on the sheet material 105 varies proportionally with said frictional resistance.

Recording means 106, for recording an image on said sheet material 105, is composed of a platen roller 106*a* and a recording head 106*b*. The platen roller 106*a* is composed of a material of a high frictional coefficient, such as hard rubber, formed as a roller, and is rotatably supported in the main body 100 and driven by a motor 120. As shown in FIG.

14, the rotation of the motor 120 is transmitted from a gear 121*a* fixed to the motor shaft, through an intermediate gear 121*b*, to a gear 121*c* fixed on the shaft of the platen roller 106*a*, thereby rotating the platen roller 106*a*. Said platen roller 106*a* serves also as transport means for the sheet material 105.

The recording head 106*b* heats the sheet material 105 according to the image signals to form an image on said sheet material 105, and is pressed to the platen roller 106*a* across said sheet material 105. More specifically said head is rotatably mounted about a shaft 106*c* on the cover 102, and is pressed to the platen roller 106*a* by a compression spring 106*d* when the cover 102 is closed. Consequently the sheet material 105 is advanced by the rotation of the platen roller 106*a* while said sheet 105 is sandwiched between the platen roller 106*a* and the recording head 106*b*.

The recording head 106*b* in the present embodiment is composed of so-called line thermal head having a plurality of heat-generating elements $\mathbf{106}b_1$ arranged on a face in contact with the sheet material 105 along the transversal direction of the sheet material 105, and the energization of said heat-generating elements $\mathbf{106}b_1$ according to the image signals selectively heats the sheet material 105, thereby developing a color on the thermal recording sheet 105.

The cutter 107 in the present embodiment is composed of a rotary cutter consisting of a fixed blade 107*a* and a driven blade 107*b*. More specifically the fixed blade 107*a* is fixed on the main body 1, while the driven blade 107*b* is rotatable about a shaft 107*c* and, when rotated by drive means, cuts the sheet material 105 in cooperation with the fixed blade 107*a*. Said driven blade 107*b* may be driven by the motor 120 for driving the platen roller 106*a*, or by another independent motor.

The sheet material 105 cut by said cutter 107 is discharged to a stacker 109 by discharge rollers 108 driven by drive means (not shown). The sheet material 105 used in the recording is curled when pulled out from the roll 105*a*, because of winding around the core 105*b*, the level of said curling depends on the diameter of the roll 105*a*.

Figure 14:
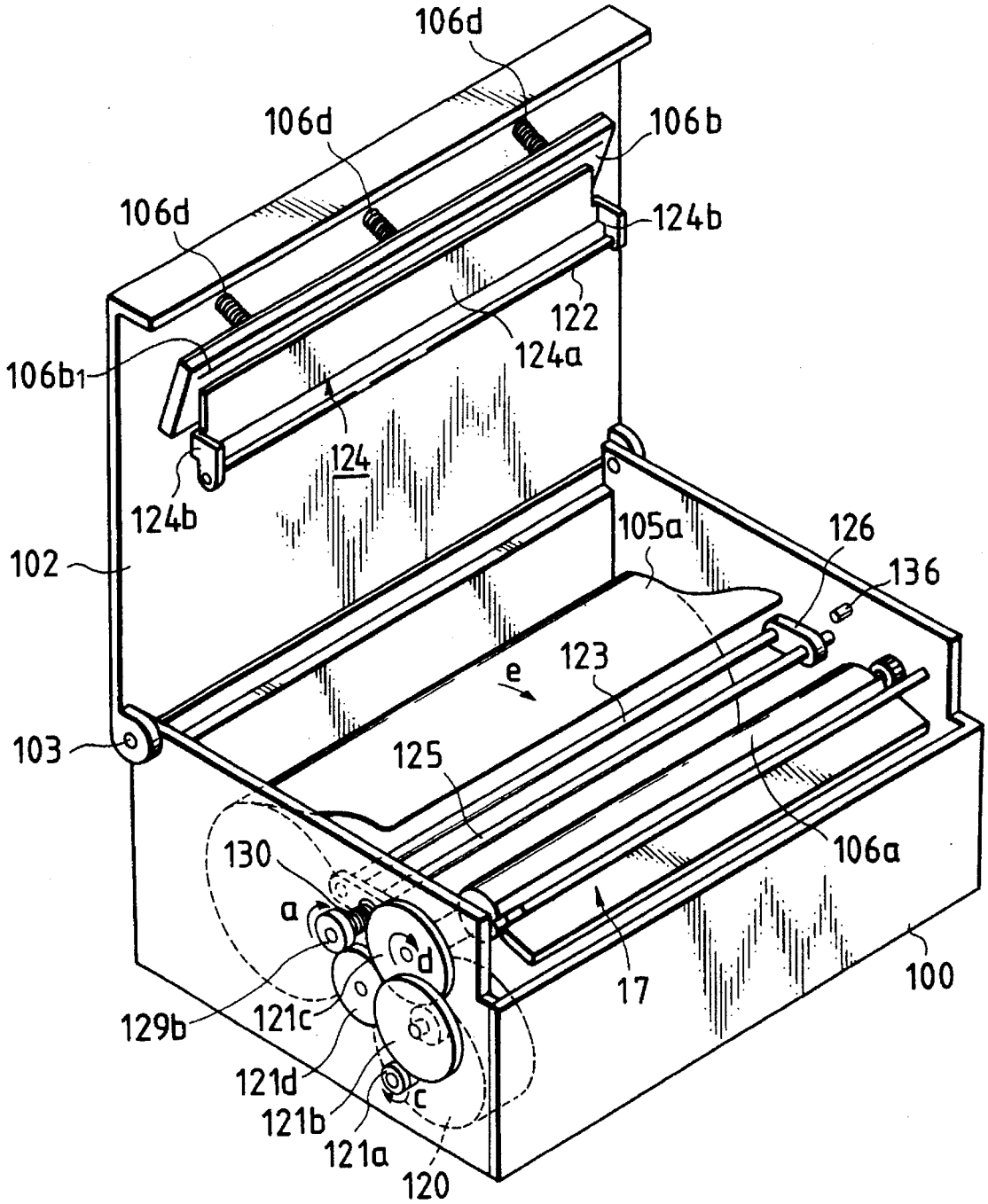
FIGS. 14 and 15 are perspective view of an embodiment in which the present invention is applied to the recording system of a facsimile apparatus.
Figure 15:
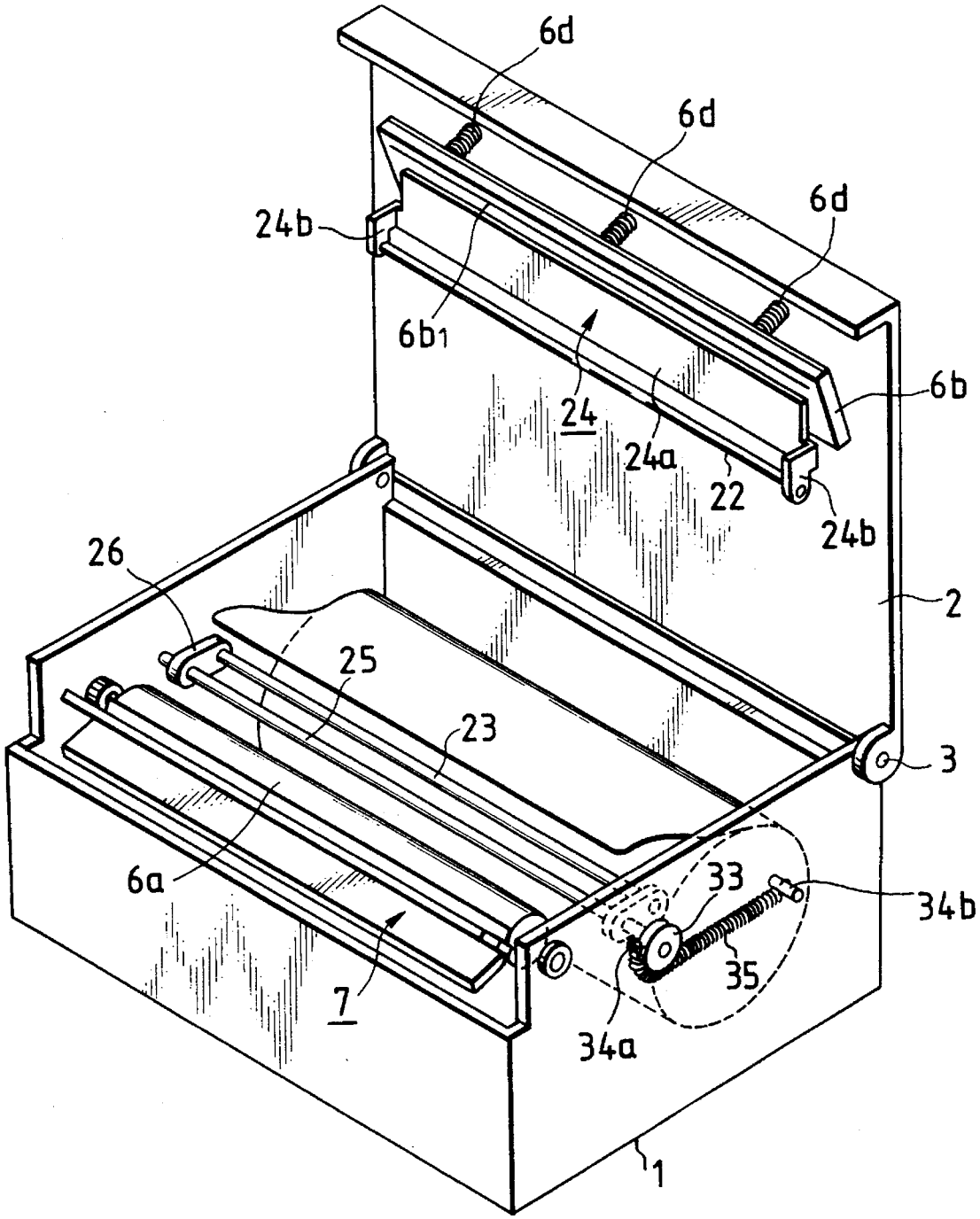

As shown in FIGS. 14 and 15, a curl correction shaft 122 is rotatably mounted on a mounting member 124 fixed on the cover 102. Said mounting member 124 is composed of a flat plate 124*a* serving as a guide for the sheet material 105, and brackets 124*b* standing on both ends of said flat plate 124*a*, wherein the distance of said brackets 124*b* is larger than the width of the sheet material 105 but smaller than the distance of arms supporting the both ends of the guide shaft 123 to be explained later. Said brackets 124*b* rotatably support the curl correction shaft 122.

Figure 17:
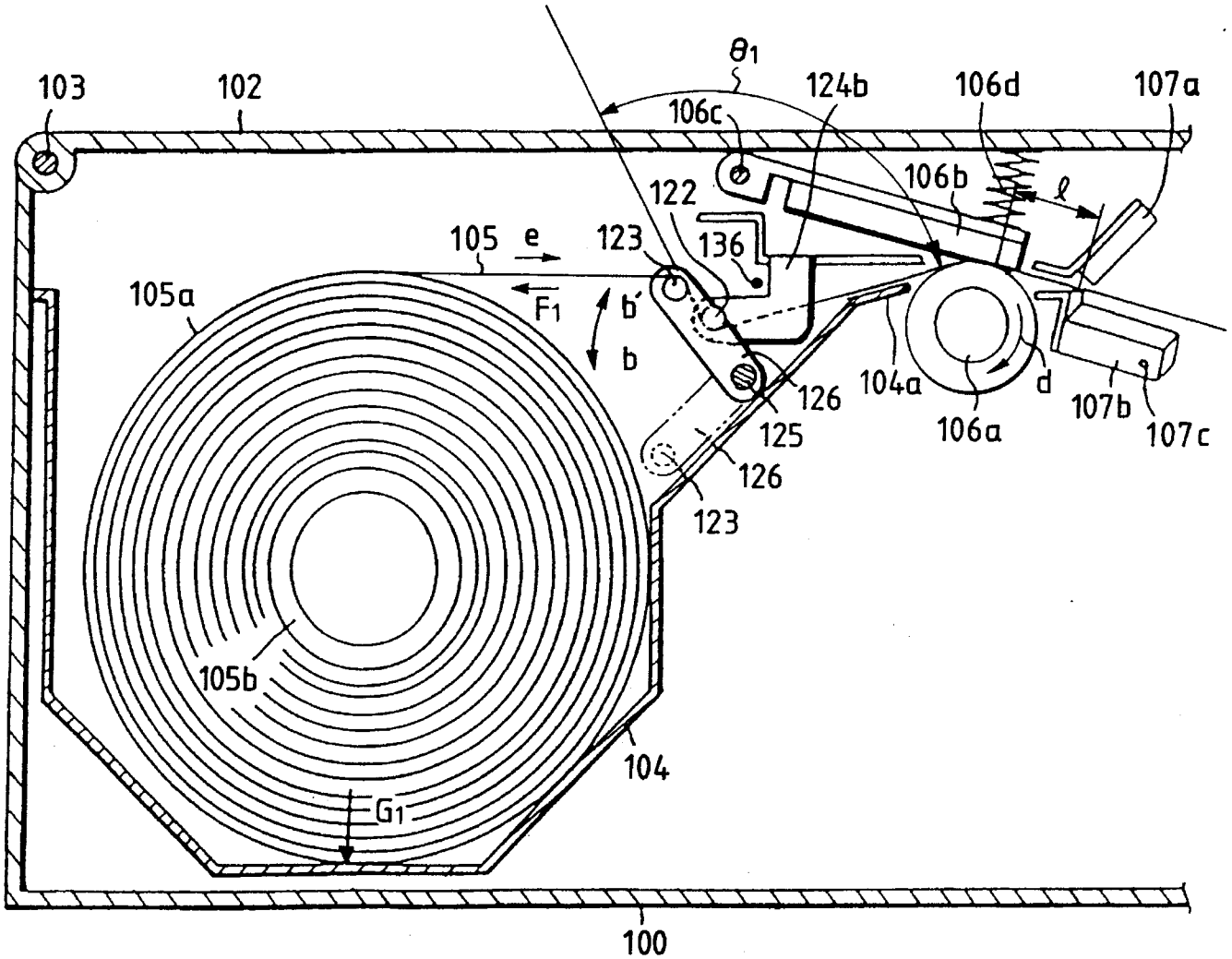
FIG. 17 is a schematic view of recording state with a loaded roll of a large diameter.
Figure 18:
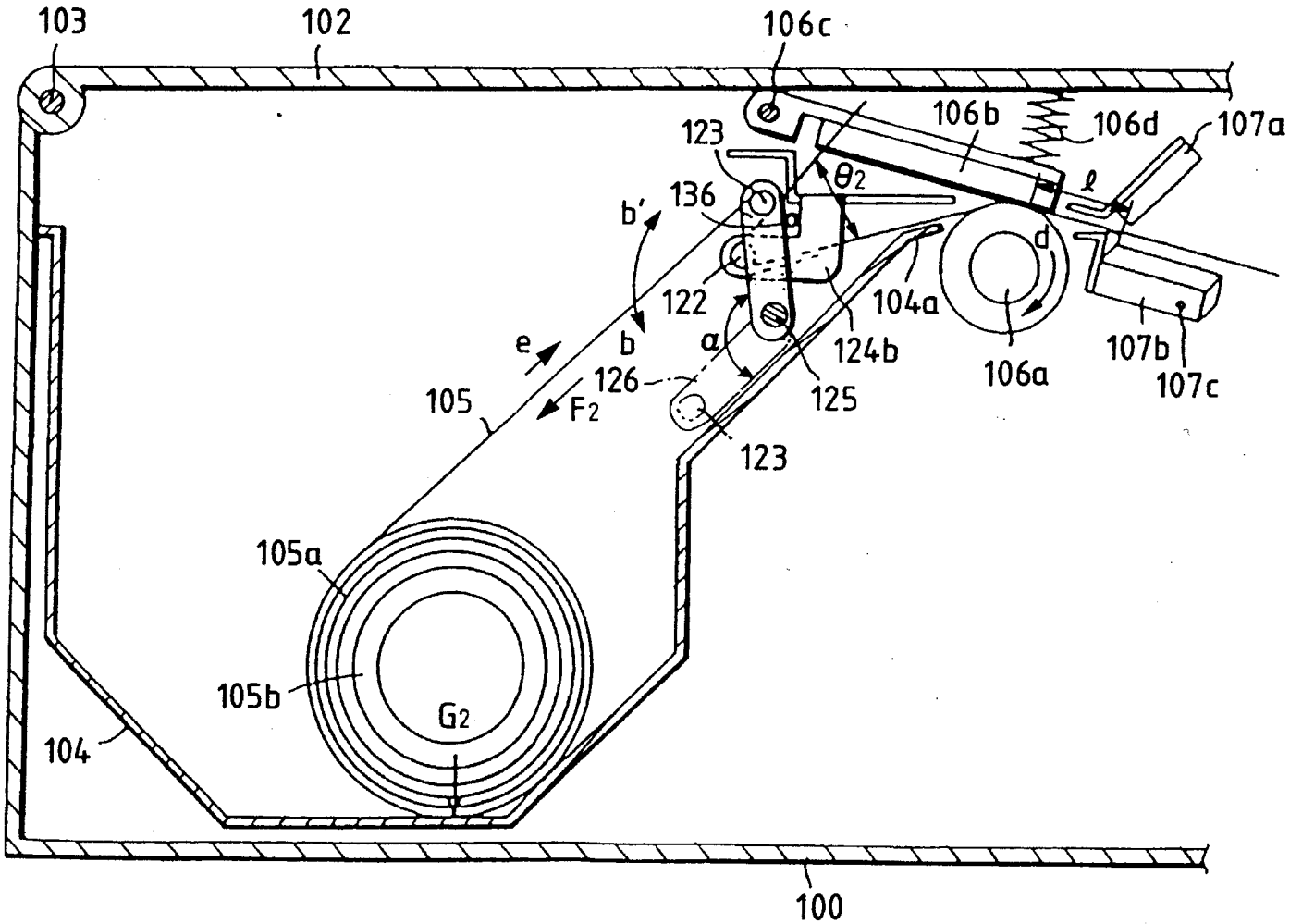
FIG. 18 is a schematic view of recording state with a loaded roll of a small diameter.

As shown in FIGS. 17 and 18, said shaft 122 is always maintained in a constant position in the main body 100 when the cover 102 is closed, said position being at the upstream side of the platen roller 106*a* in the transport direction of the sheet material 105, so as not to excessively increase the introduction angle of the sheet material 105 into the platen roller 106*a*.

Opposed to said curl correction shaft 122, there is provided a guide plate 104, for guiding the sheet material 105 pulled out from the roll 105*a* to the platen roller 106*a*. Said guide 104*a* is extended at an end thereof to the vicinity of the platen roller 106*a*, and is integrally united, at the other end, with the roll holder 104.

The guide shaft 123 is rendered movable by moving means, with respect to the curl correction shaft. 122. As shown in the perspective view in FIG. 19 and the cross-sectional view in FIG. 20, said moving means is composed of a shaft 125 mounted in the main body 100 and two arms 126 fixed to said shaft 125 and rotatably supporting the guide shaft 123, whereby the rotation of the shaft 125 causes integral displacement of the arms 126 thereby moving the guide shaft 123 with respect to the curl correction shaft 122.

Said shaft is rotatably supported by bearings 127 mounted on the main body 100, and is provided, at an end thereof, with a clutch flange 128, a clutch gear 129 and a spring clutch 130 for transmitting the one directional rotating force to the shaft 125. Said clutch flange 128 is composed of a cylindrical portion 128*a* and a flange portion 128*b* and integrally rotates with said shaft 125 by means of an engaging pin 131.

The clutch gear 129 is composed of a cylindrical portion 129*a* and a gear portion 129*b*, and has a central hole slightly larger than the diameter of the shaft 125, whereby said gear 129 is rotatably fitted on said shaft 125.

The spring clutch 130 is composed of a coil of a steel wire, a steel belt or a plastic wire, wound over the cylindrical portions 128*a*, 129*a* of the clutch flange 128 and clutch gear 129, and engages with the flange portion 128*b* of the clutch flange 128 at an end. The other end is bent outward to constitute an engaging portion 130.

Said spring clutch 130 transmits the rotation of the clutch gear 129, only in one direction, to the clutch flange 128. More specifically, when the clutch gear 129 rotates in the direction a shown in FIG. 19, the spring clutch 130 becomes slack and the rotation is not transmitted to the clutch flange 128. On the other hand, when the clutch gear 129 rotates in the opposite direction a' (hereinafter the sign ' indicates opposite direction), the spring clutch 130 is tightened over the cylindrical portions 128*a*, 129*a* to maintain these portions in a locked state, whereby the rotation is transmitted to the clutch flange 128 thereby moving the guide shaft 122 in the direction b.

Said clutch gear 129 is driven by the motor 120 used for driving the platen roller 106*a*. As shown in FIG. 14, the power of the motor 120 is transmitted to the platen roller 106*a* through the gears 121*a*–121*c* as explained before, and the gear 121*c* on the platen roller shaft meshes with the gear portion 129*b* of the clutch gear 129 through an intermediate gear 121*d*.

Consequently the forward rotation, in the direction c of the motor 120 as shown in FIG. 14 causes the rotation of the platen roller 106*a* in the direction d, thereby rotating the clutch gear 129 in the direction a. Thus, when the platen roller 106*a* rotates for advancing the sheet material 105 in the direction e, the spring clutch 130 is in the non-transmitting free state.

Figure 19:
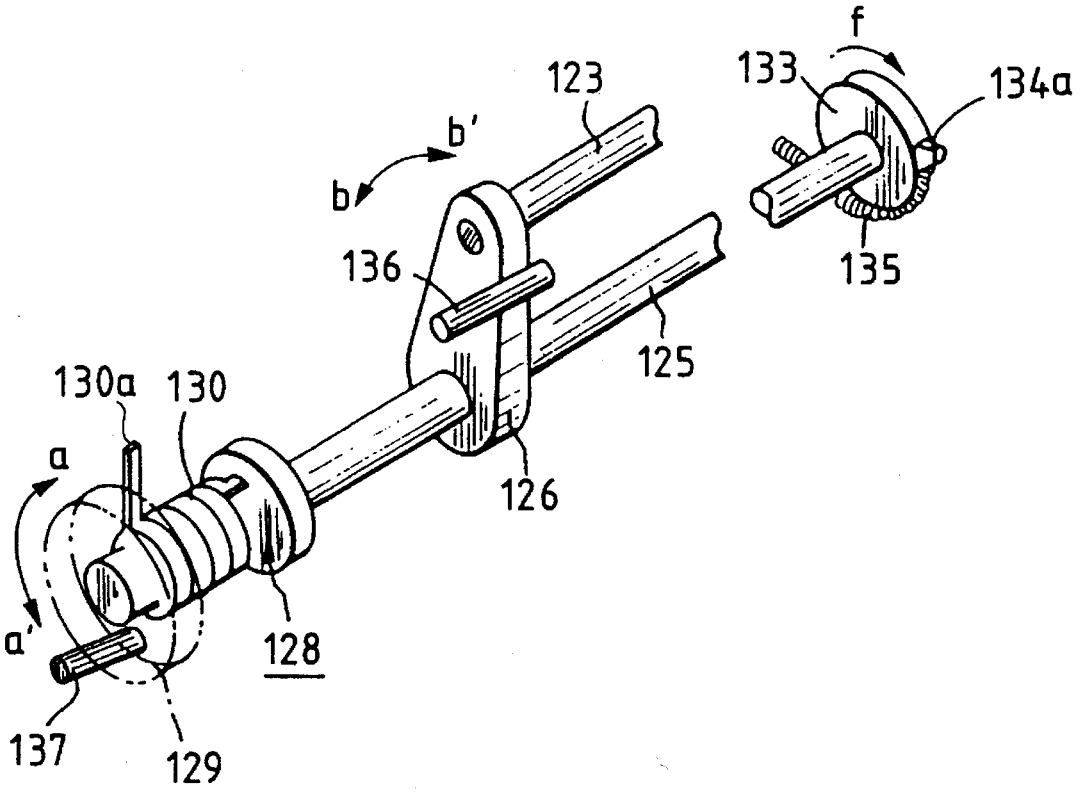
FIGS. 19 and 20 are schematic views of a curl correction mechanism.

When the motor 120 rotates in the opposite direction c', the platen roller 106*a* so rotates as to reverse the sheet material 105, and the clutch gear 129 rotates in the direction a' to maintain the spring clutch 130 in the locked state, thereby rotating the guide shaft 123 in the direction b shown in FIG. 19.

In the following, there will be explained the structure of means for biasing said guide shaft 123 so as to balance with the tension of the sheet material 105.

Figure 20:
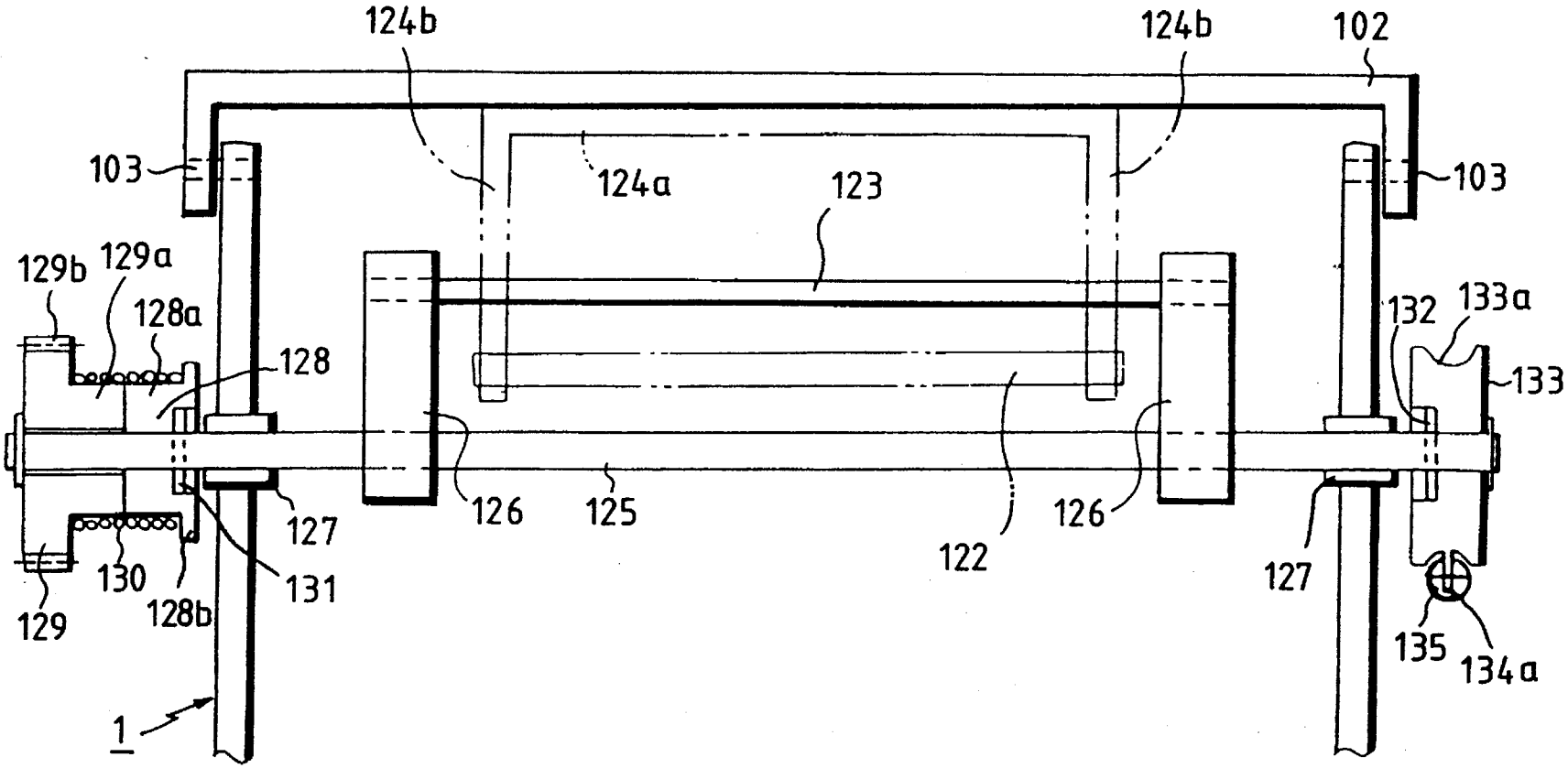

As shown in FIGS. 19 and 20, a pulley 133 is fixed, by a pin 132, to the other end of the shaft 125. The periphery of said pulley 133 is provided with a groove 133*a* and a hook 134*a* at a predetermined position. A tension spring 135 is provided, under a tension, between said hook 134*a* and a hook 134*b* (FIG. 15) provided in the main body 100, whereby the pulley 133 is constantly biased in a direction f in FIG. 19 (direction for increasing the curl correction effect by the guide shaft 123).

Also in the main body 100, there are provided stoppers 136 in the rotating range of said arms 126. Said stopper 136 engages with the arm 126 when it rotates in the direction b' in FIG. 19, thereby limiting the rotation in said direction, thus defining the maximum wrapping amount of the sheet material 105 on the curl correction shaft 122.

Further as shown in FIGS. 19 and 21, a stopper 137 is provided in the main body 100, in the rotating range of the engaging portion 130*a* of the spring clutch 130. Said stopper 137 serves to limit the rotation of the spring clutch 130 rotating with the gear 129 in the locked state in response to the rotation of the clutch gear 129 in the direction a', thereby limiting the rotation of the arms 126. More specifically, if the clutch gear 129 rotates in said direction a' while the engaging portion 130*a* is in contact with the stopper 137, the spring clutch 130 is loosened whereby the rotation is not transmitted to the clutch flange 128 and the rotation of the arms 126 in the direction b is limited. Consequently, the arms 126 rotate within the range defined by the stoppers 136, 137.

In the following there will be explained the recording operation with the recording system B equipped with the above-explained curl correction mechanism, with emphasis on the curl correcting function for a large roll diameter shown in FIG. 17 and a small roll diameter shown in FIG. 18.

At first the cover 102 is opened, then the sheet roll 105*a* is loaded in the roll holder 104 and the leading end of the sheet is pulled out to the platen roller 106*a*. Since the curl correction shaft 122 is mounted on the cover 102 while the guide shaft 123 is mounted in the main body 100, said shafts 122, 123 are separated by the opening of the cover 102 as shown in FIGS. 14 and 15 to facilitate the setting of the sheet material 105.

When a recording start signal is entered after the closing of the cover 102, the motor 120 rotates in the forward direction to rotate the platen roller 106*a* in the direction d, thereby advancing the sheet material 105 in the direction e. In synchronization the heat-generating elements 106$b_1$ of the recording head 106*b* are selectively energized to form a record on the sheet material 105. In the course of transportation of said sheet material 105, the curl thereof is corrected by the function of the curl correction mechanism A. The forward rotation of the motor 120 is transmitted to the clutch gear 129, but not to the clutch flange 128 because of the above-explained free state of the spring clutch 130.

On the other hand, the shaft 125 is biased in the direction f by the tension spring 135 as shown in FIG. 19, whereby the guide shaft 123 moves by the rotation of the arms 126 in the direction b' and stops at a position balanced with the tension on the sheet material 105.

Thus the sheet material 105, in the transport path thereof, wraps the guide shaft 123 in the direction of curl of the sheet roll 105*a*, and the curl correction shaft 122 in the opposite direction. The curl correction is achieved by said wrapping of the sheet material 105 on the shaft 122.

The tension on the sheet material 105 is determined by the contact friction between the roll holder 104 and the roll 105*a* loaded therein. As shown in FIG. 17, the sheet 105 before and after the guide shaft 123 is subjected to a tension F1, corresponding to the weight G1 of the roll 105*a*. When the guide shaft 123 moves in the direction b', the wrapping amount of the sheet material 105 on the shaft 123 increases whereby the rotating power of the arm 126 (torque of the pulley 133 by the tension spring 135) increases against the synthesized tension F1. Thus the arms 126 stop at a position where said rotating force of the arms 126 balances with said synthesized tension.

When the roll diameter is large as shown in FIG. 17, the sheet material 105 shows an angle θ1 before and after the curl correction shaft 122 when the tension F1 of the sheet 105 balances with the rotating force of the arms 126.

When the roll diameter is reduced as shown in FIG. 18, the roll weight is reduced to G2 (<G1) so that the tension on the sheet material 105 is also reduced to F2 (<F1). Thus the arms 126 rotate further in the direction b' than in the case of larger roll diameter, and stop at a position where the rotating force thereof balances with the afore-mentioned resistance, or in contact with the stopper 136 if the rotating force is larger. In this case the angle θ2 of the sheet material 105 before and after the curl correction shaft 122 is smaller than the angle θ1 corresponding to the larger roll diameter.

Consequently, the wrapping amount of the sheet material on the shaft 122 is small for a large roll diameter, but increases as the curl becomes stronger for a smaller roll diameter. The curl correcting effect becomes stronger as said wrapping amount increases because the sheet material 105 is more strongly bent opposite to the direction of curl. Thus the curl correcting effect appears stronger at a smaller roll diameter where the curling becomes stronger.

As explained in the foregoing, the curl correction mechanism A is capable of appropriate curl correction, by varying the correcting effect according to the level of curling, utilizing the balance of the tension on the sheet material 105 and the rotating force on the arms 126.

The arms 126 are biased by the tension spring 135, and the rotation of the motor 120 in the direction c is transmitted to the platen roller 106*a* but not to the arms 126. Consequently, the precision of sheet transportation can be improved to achieve a high quality recording, as the power for moving the arms 126 is not required for the motor 120 at the image recording.

The sheet material 105 thus subjected to curl correction is then subjected to image recording, then cut with the cutter 107 and discharged by the discharge rollers 108.

On the other hand, the sheet material 105 remaining in the apparatus is transported backward by a distance l corresponding to the distance between the position of the cutter 107 to the recording means 106, in order to avoid formation of an empty space in the leading end part of the sheet 105 at the next recording. For this purpose the motor 120 is reversed by a predetermined amount, whereby the power thereof is transmitted not only to the platen roller 106*a* but also to the clutch flange 128 through the spring clutch 130 in the locked state as explained before, thus generating a force to rotate the arms 126 in the direction b.

Figure 21A:
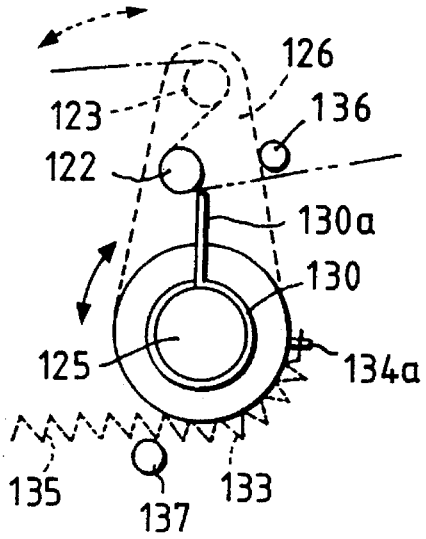
FIGS. 21A 21B and 21C are views showing the relations of a spring clutch and a stopper.
Figure 21B:
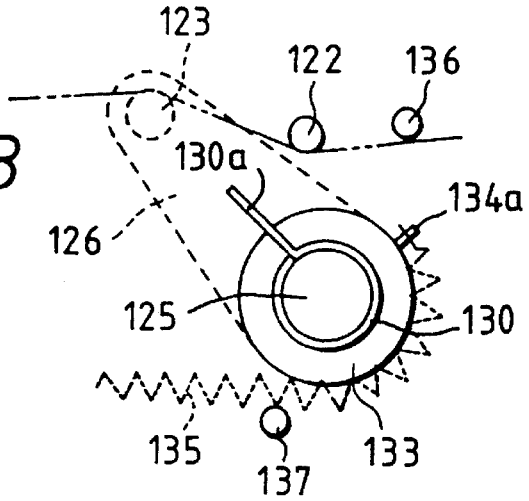
Figure 21C:
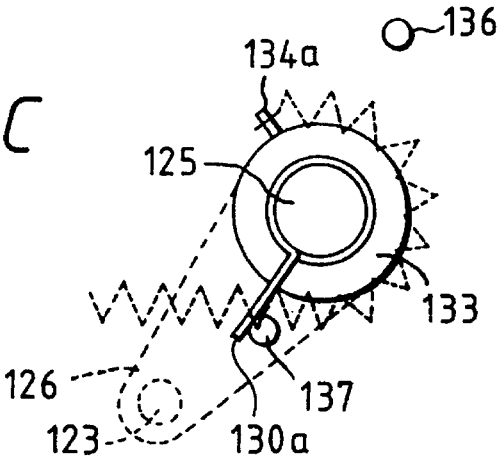

In this state the tension spring 135 exerts a force against said rotation, as shown in FIGS. 19 and 21. For this reason, the reversing power of the motor 120 in the present embodiment is selected larger than the arm rotating force of the tension spring 135. Therefore, when the motor 120 is reversed for reversing the sheet material 105, the arms 126 are rotated in the direction b and separated from the sheet material 105. At the same time the engaging member 130*a* of the spring clutch 130 rotates substantially integrally with the arms 126 (FIG. 21 A→B→C), and the spring clutch 130 becomes loose when the clutch gear 129 rotates while the engaging member 130*a* is in contact with the stopper 137 as shown in FIG. 21C. Thus the clutch gear 129 slips with respect to the clutch flange 128, and the arms 126 returns to the initial position.

Said initial position is defined in such a manner that the guide shaft 123 does not close the aperture of the roll holder 104, and the guide shaft 123 does not interfere with the curl correction shaft 122 at the opening of the cover 102. More specifically, the engaging member 130*a* of the spring clutch 130 is in contact with the stopper 137 as shown in FIG. 21C. In this state, since the guide shaft 123 is separated from the sheet material 105, a curling of opposite direction is not generated even in a prolonged stand-by state.

The motor 120 stops after the reversing of the sheet material 105 by said amount l, and the arms 126 are in a biased state by the tension spring 135. As shown in FIG. 19, said tension tends to rotate the pulley 133 in the direction f, whereby the spring clutch 130 is locked and biases the clutch gear 129 in the direction a, thereby giving a torque to the motor 120 through the gears 121*a*–121*d*.

In the recording apparatus of the present embodiment, the arms 126 in the stand-by state are maintained in the initial position, represented by double-dotted chain lines in FIGS. 17 and 18. Consequently, in opening the cover 102 for example for loading the roll 105*a*, the guide shaft 123 does not interfere with the curl correction shaft 122, and the cover 102 can be smoothly opened.

The apparatus of the present embodiment of the above-explained structure is not only capable of curl correction according to the level of curling, but also precise sheet transportation since the motor 120 is only required to rotate the platen roller 106*a* at the recording. Furthermore the replacement of the roll 105*a* can be easily achieved.

Figure 22:
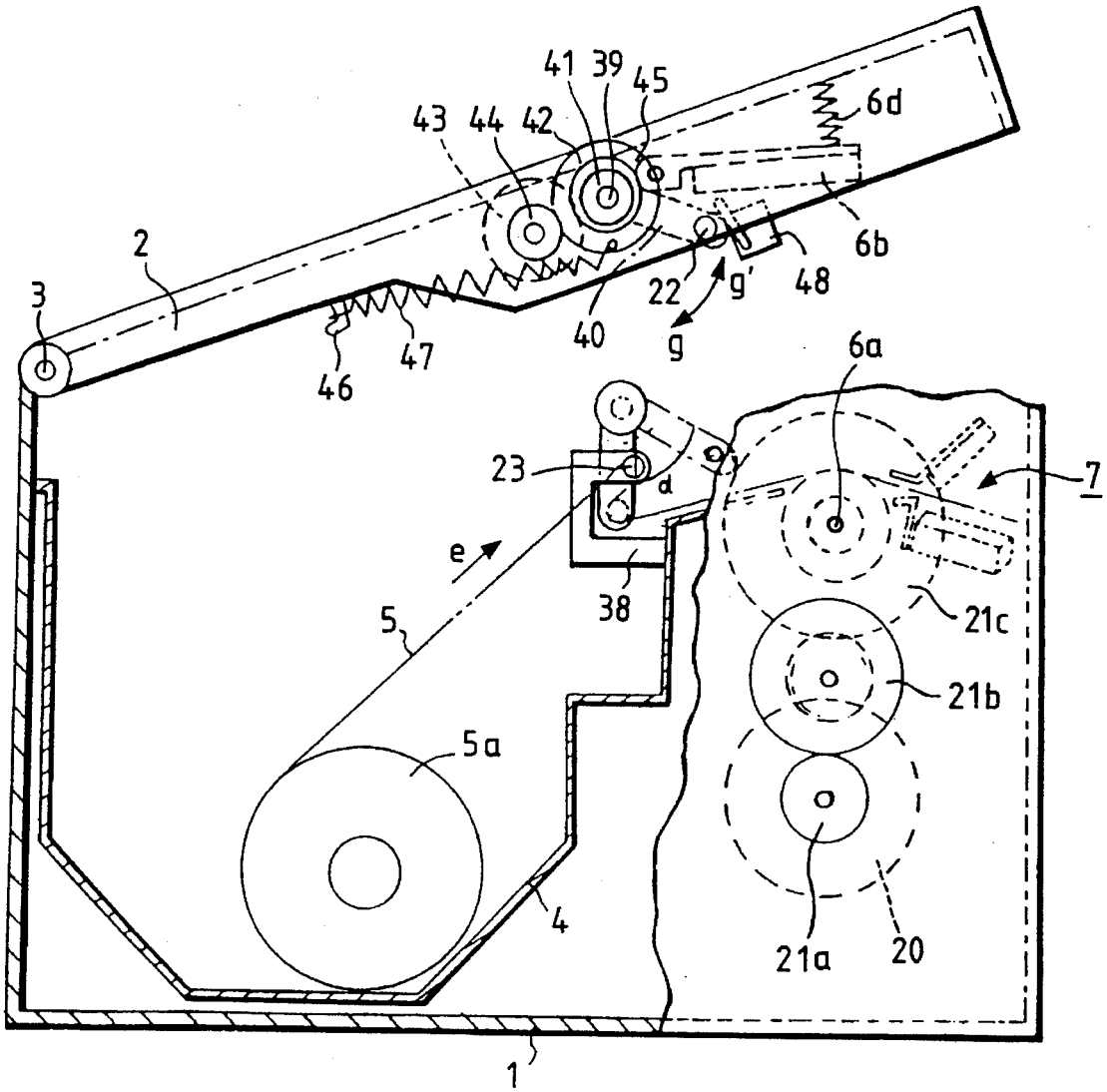
FIG. 22 is a schematic view of another embodiment.
Figure 23:
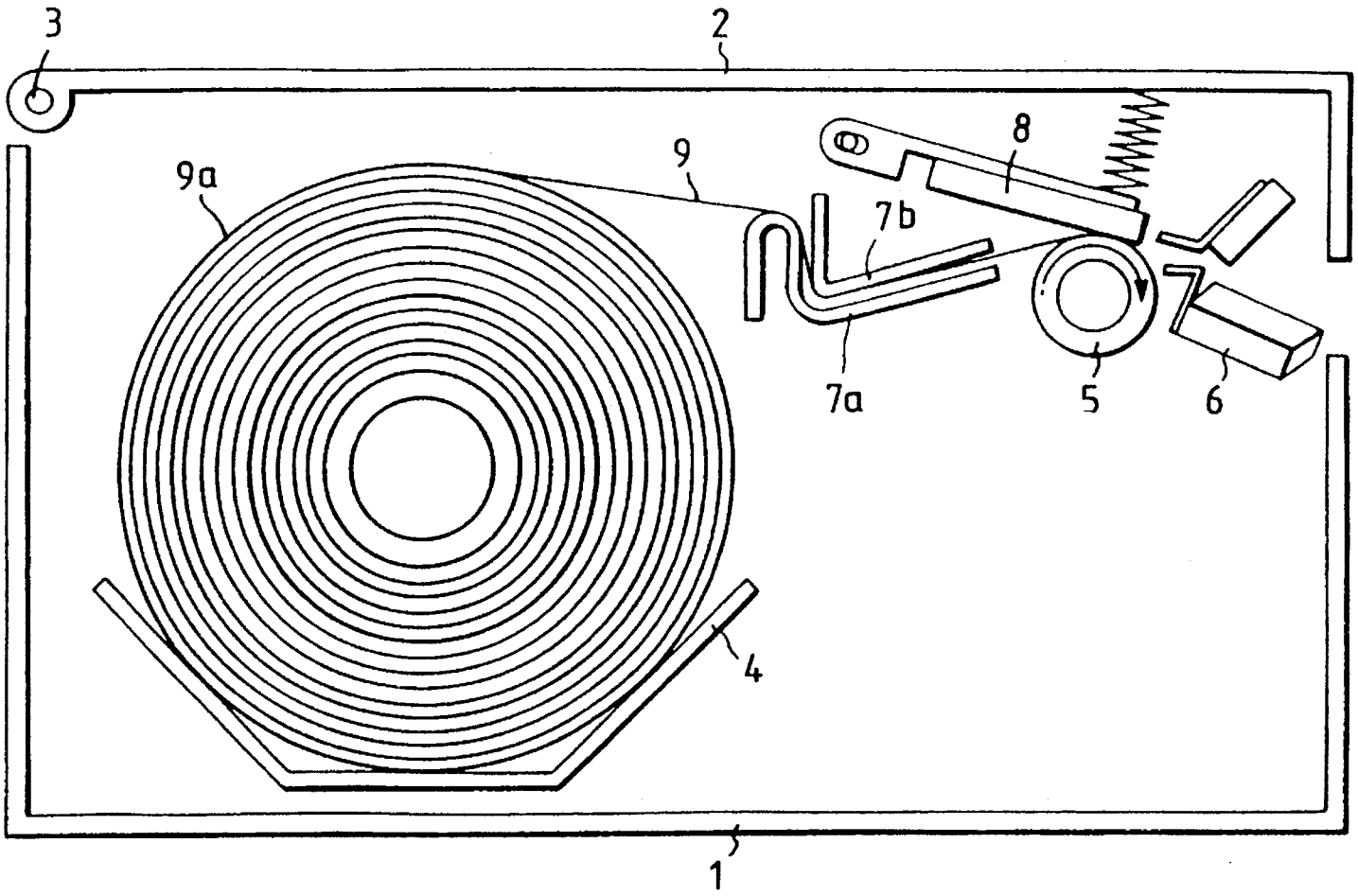
FIG. 23 PRIOR ART
FIGS. 23 and 24 are schematic views of prior art devices.
Figure 24:
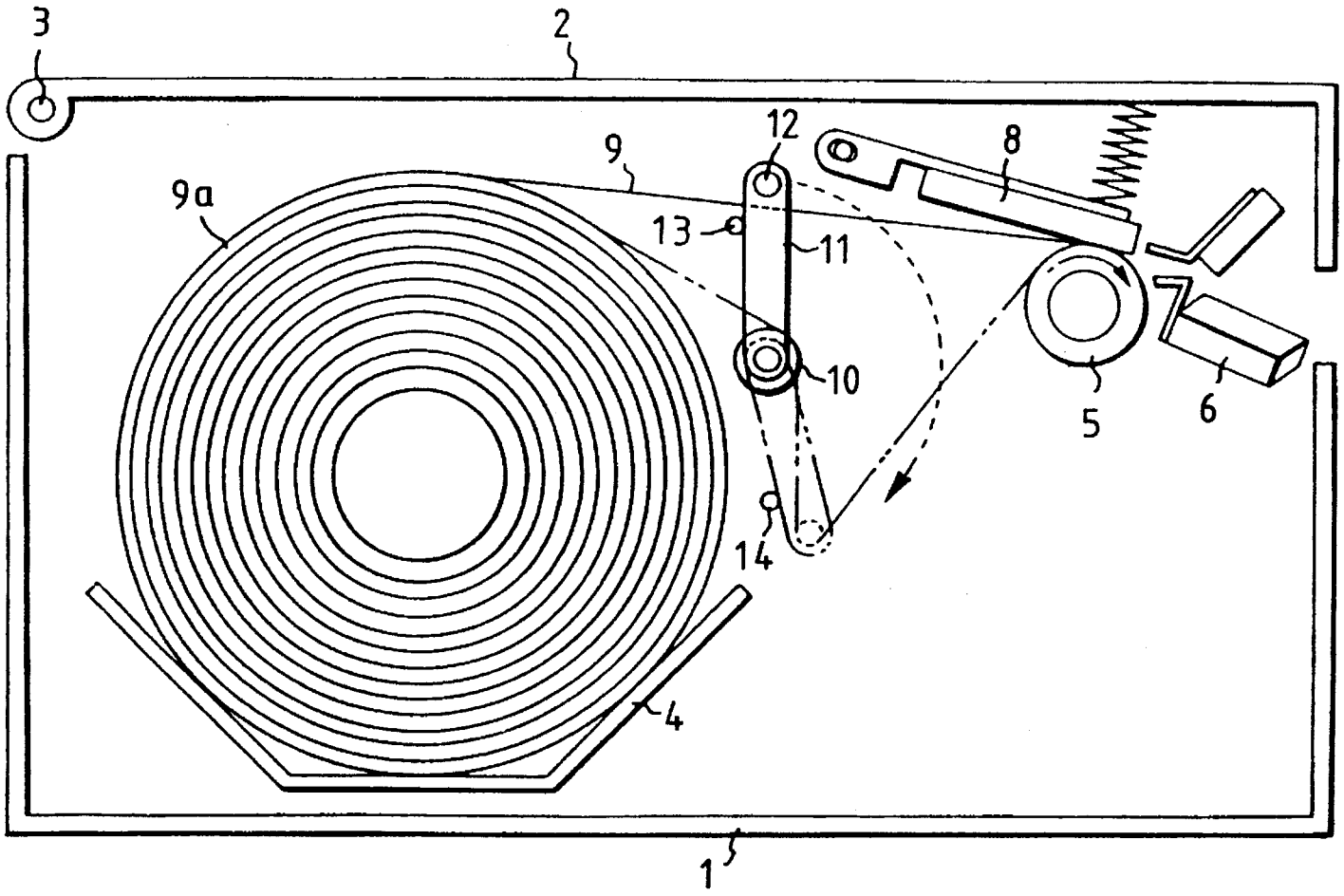
FIG. 24 PRIOR ART

In the foregoing embodiment, the guide shaft 123 is rendered movable with respect to the curl correction shaft 122. Now, FIG. 22 illustrates another embodiment in which the guide shaft 123 is rendered movable with respect to the curl correction shaft 122. In FIG. 22, same or equivalent components as those in FIGS. 14 to 19 are represented by same numbers and will not be explained further.

Referring to FIG. 22, the guide shaft 23 is rotatably supported by support members 38 of the main body 1. The curl correction shaft 22 is rotatably mounted on arms 40 fixed to a shaft 39 which is rotatably mounted on the cover 2, and effects curl correction for the sheet material 5 when the arms 40 are rotated in a direction g, but are released from said curl correction when the arms 40 are rotated in a direction g'.

On an end of said shaft 39 there is rotatably mounted a clutch gear 42 fixed to a solenoid clutch 41, which, in response to a signal from a control unit (not shown), transmits or does not transmit the rotation of said clutch gear 42 to the shaft 39. Said clutch gear 42 meshes with a gear 44 mounted on a motor 43, whereby the rotation of said motor 43 is transmitted to said clutch gear 42.

On the other end of said shaft 39 there is fixed a pulley 45 as in the foregoing embodiment, and a tension spring 47 is provided between a projection formed on the periphery of said pulley and a hook 46 provided in a predetermined position on the cover 2, thereby biasing the arms 40 constantly in the direction g.

Also in the rotating range of the arms 40 on the cover 2 there is provided a microswitch 48 which is actuated by the arms 40 upon arriving at the initial position by rotation in the direction g', whereby the motor 43 is stopped by a signal from said microswitch 48.

In the above-explained structure, the solenoid clutch 41 is energized in the stand-by state, whereby the arms 40 are maintained in the double-dotted chain line position by the self-holding force of the motor 43. Consequently, the curl correction shaft 122 and the guide shaft 23 do not interfer each other at the opening of the cover 2, so that the replacement of the roll 5*a* can be easily achieved.

At the image recording, the cover 2 is closed, and the motor 20 is activated to rotate the platen roller 6*a*, thereby advancing the sheet material 5 in the direction e. At the same time the recording head 6*b* is activated according to the image signals to form an image on the sheet material 5. Simultaneous with the activation of the motor 20, the solenoid clutch 41 is turned off whereby the arms 40 rotate in the direction g by the tension spring 47, and the curl correction shaft 22 is brought into contact with the sheet material 5 as represented by solid lines in FIG. 22. The position of said shaft 22 is determined by the balance of the biasing force of the tension spring 47 and the tension of the sheet material 5 as in the foregoing embodiment, and the curl correction of the sheet material 5 is achieved by bending with the shaft 22 opposite to the direction of curling.

After the recording, the motor 20 is reversed to move the leading end of the sheet material 5 from the cutter 7 to the platen roller 6*a*. At the same time the solenoid clutch 41 is energized and the motor 43 is reversed by a predetermined amount to rotate the arms 40 in the direction g'. When the arms 40 are retracted to the initial position, the microswitch 48 is actuated to stop the motor 43, whereby the curl correction shaft 22 is retained in the initial position.

The returning of the arms 40 to the initial position can be detected not only by the microswitch 48, but also any other means capable of detecting the position of the arms 40, such as a photointerruptor.

The movable curl correction shaft 22 explained above provides the same effects as in the foregoing embodiments.

As still other embodiments, it is also possible to move the guide shaft 23 or the curl correction shaft 22 in parallel manner along racks or rails, or to move said shaft by a cam. Also the shaft 22 or 23 may be fixed to the mounting members 24 or arms 26, or may be composed of a metal plate or the like suitably formed to have a predetermined radius of curvature. It is furthermore possible to construct both of the shafts 122 and 123 movable. Furthermore, the spring clutch 130 or the solenoid clutch 41 employed for selectively transmitting the power of the motor to the shaft 22 or 23 may be replaced by other devices, such as a needle clutch of roller type.

Also the guide shaft 23 is moved by the motor 20 used for driving the platen roller 6*a*, but they may naturally be driven by separate motors. Also the driving force need not necessarily supplied by a motor but by other means such as a plunger.

Also in the foregoing embodiment, a tension spring is employed for biasing the curl correction shaft 22 or the guide shaft 23 in a direction toward stronger curl correcting function, but there may be employed other means, for example, various springs such as torsion coil spirng, compression spring or spiral spring, cylinders such as air cylinder or oil cylinder, or a solenoid.

What is claimed is:

1. A recording apparatus comprising:

hold means for holding a sheet in a rolled state;

transport means for transporting the sheet in a direction drawing out from the rolled sheet held by said hold means;

a convey path where the sheet conveyed by said transport means passes, and a lid for opening said convey path;

recording means for recording an image on the sheet transported by said transport means;

a first guide member and a second guide member for correcting a curl of the sheet transported from said transport means by bending and guiding the sheet in an opposite direction to a curled direction;

support means for supporting said first guide member around a rotational axis so that said first guide member can move in a direction to strengthen or weaken the curl correcting operation; and urge means for urging said support means to be moved in the direction strengthening the curl correcting operation, wherein said first guide means generates the curl correcting operation corresponding to the diameter of rolled sheet, by guiding the sheet at a position where the transporting force applied to the sheet by said transport means, a tension force of the sheet generated by a friction force between the rolled sheet and said hold means resisting the transport force, and an urge force by said urge means are balanced, and wherein one of said first guide member and said second guide member is disposed on the main body, and the other is disposed on said lid.

2. An apparatus according to claim 1, wherein said sheet material is supported by pinching between said transport means and said recording means.

3. An apparatus according to claim 1, wherein said recording means comprises a cartridge housing an ink sheet.

4. An apparatus according to claim 3, wherein said curl correction member is mounted on said cartridge.

5. An apparatus according to claim 4, wherein said cartridge is mounted on a cover openably connected to a main body.

6. A recording apparatus according to claim 1, wherein said urge means has a resilient member generating an urge force.

7. A curl correction apparatus comprising:

a sheet transport path;

an opening member openable from a main body of said curl correcting apparatus for allowing access to said sheet transport path;

transport means for transporting a sheet along said sheet transport path;

a first guide member disposed on said opening member for guiding the sheet transported by said transport means;

a second guide member disposed on the main body of said curl correcting apparatus for guiding the sheet transported by said transport means to thereby correct a curl tendency of the sheet in corporation with said first guide member;

a rotary member for supporting said first or second guide member, said rotary member being capable of rotating to establish a first condition where said second guide member is located between said opening member and said first guide member, and a second condition where it is not located between said opening member and said first guide member; and rotating means for rotating said rotary member for establishing the first or second condition.

8. An apparatus according to claim 7, wherein said holder means comprises a supporting face for supporting the rolled sheet material.

9. An apparatus according to claim 7, wherein said second guide member has a cylindrical member having a guide face on the external periphery thereof.

10. An apparatus according to claim 7, wherein said second guide member has a rotatable cylindrical member.

11. An apparatus according to claim 7, further comprising support member for movably supporting said first guide member.

12. An apparatus according to claim 7, wherein said urge means comprises a drive source and a frictional joint, and is adapted to provide said moving force by transmitting the driving force of said drive source through said frictional joint.

13. An apparatus according to claim 12, wherein said drive source of said urge means also serves to drive said transport means.

14. An apparatus according to claim 7, wherein said first guide member is provided in a main body while said second guide member is provided on a cover which is openably connected to said main body.

15. An apparatus according to claim 7, wherein said urge means comprises an elastic member for biasing said first guide member.

16. A curl correction apparatus comprising:

hold means for holding a rolled sheet with a periphery thereof in frictional contact with said hold means;

transport means for transporting the sheet held by said hold means;

a convey path where the sheet conveyed by said transport means passes, and a lid for opening said convey path;

a curl correcting member positioned between said hold means and said transport means for correcting curl of the sheet;

a guide member for guiding the sheet to be wound around said curl correction member;

a rotary arm for supporting at least one of said curl correcting member and said guide member;

a rotary member rotatable together with said rotary arm around a rotary axis thereof common to that of said rotary arm; and urge means for urging said rotary member so that said rotary arm is rotated in a direction strengthening the curl correcting operation, wherein said first guide member generates the curl correcting operation corresponding to a diameter of the rolled sheet, by guiding the sheet at a position where a transport force applied to the sheet by said transport means, a tension force of the sheet generated by a friction force between the rolled sheet and said hold means resisting the transport force, and an urge force by said urge means are balanced, and wherein one of said first guide member and said second guide member is disposed on the main body, and the other is disposed on said lid.

17. An apparatus according to claim 16, wherein said holder means comprises a supporting face for supporting the rolled sheet material.

18. An apparatus according to claim 16, wherein said curl correction member has a cylindrical member having a guide face on the external periphery thereof.

19. An apparatus according to claim 16, wherein said guide member has a rotatable cylindrical member.

20. An apparatus according to claim 16, wherein said urge means comprises a drive source, and plural transmission members for transmitting the driving force of said drive source as a rotating force for said support means.

21. An apparatus according to claim 20, wherein said urge means comprises a frictional joint.

22. An apparatus according to claim 20, wherein said drive source also serves to drive said transport means.

23. An apparatus according to claim 16, wherein said guide member is provided in a main body while said curl correction member is provided on a cover which is openably connected to said main body.

24. An apparatus according to claim 16, wherein said urge means comprises an elastic member for biasing at least one of said curl correction member and said guide member.

25. A curl correcting apparatus, comprising:

hold means for holding a sheet in a rolled state;

transport means for transporting the sheet in a first direction drawing out the sheet from said hold means, and a second direction opposite to the first direction;

curl correcting means for correcting a curl of the sheet transported by said transport means;

urge means for strengthening the curl correcting operation of said curl correcting means; and transmit means for transmitting a drive force of said transport means to said curl correcting means to weaken the curl correcting operation of said curl correcting means when said transport means transports the sheet in the second direction.

26. A curl correcting apparatus according to claim 25, further comprising control means for controlling said release means to release the curl correcting operation of said curl correcting means.

27. A curl correcting apparatus according to claim 25, wherein the sheet is wound in such a direction that a face of said sheet opposite to said opening member is curled inwards.

28. A curl correcting apparatus according to claim 25, wherein said second and first guide members are adapted to guide the sheet in contact with respectively different faces of the sheet.

29. A curl correcting apparatus according to claim 28, wherein said first guide member has a first guide face of cylindrical shape contacting said sheet.

30. A curl correcting apparatus to claim 25, wherein said urge means shifts said first guide member in a direction strengthening the curl correcting operation.

31. A curl correcting apparatus according to claim 30, wherein said urge means is adapted to move said first or second guide member in a direction for bending the sheet in a direction opposite to the direction of curl formed in said sheet, as the diameter of the rolled sheet stored in said storage means decreases.

32. A curl correcting apparatus according to claim 25, wherein said urge means comprises a resilient member generating the urge force.

33. A recording apparatus, comprising:

hold means for holding a sheet in a rolled state;

transport means for transporting the sheet in a first direction drawing out the rolled sheet from said hold means or in a second direction opposite thereto;

record means for effecting a recording onto the sheet transported in the first direction transported by said transport means;

curl correcting means for correcting a curl of the sheet transported by said transport means; and a cutter for cutting the sheet having been recorded on after completion of the recording by said record means;

drive means for driving said curl correcting means to weaken the curl correction operation when said transport means transports the sheet in the second direction to return a leading end thereof toward said record means after cutting of the sheet by said cutting means.

34. A recording apparatus according to claim 33, wherein said transport means is adapted to transport a sheet wound in a roll.

35. A recording apparatus according to claim 34, further comprising an opening member openable to access said sheet transport path, and wherein the sheet is wound in such a direction that a face of said sheet opposite to said opening member is curled inwards.

36. A recording apparatus according to claim 35, wherein said curl correcting means has a first guide member and a second guide member that in cooperation bend the sheet in a direction for correcting the curl.

37. A curl correcting apparatus according to claim 36, wherein said second guide member is adapted to guide the sheet in contact with a face of the sheet opposite to the face thereof contacting said first guide member.

38. A curl correcting apparatus according to claim 37, wherein said first guide member has a first guide face of cylindrical shape contacting said sheet.

39. A curl correcting apparatus according to claim 37, wherein one of said first and second guide members is shifted to establish the first condition during the curl correcting operation.

40. A recording apparatus comprising:

a sheet transport path;

an opening member openable from a main body of said recording apparatus to access said sheet transport path;

transport means for transporting a sheet along said sheet transport path;

a first guide member, mounted on said opening member, for guiding the sheet transported by said transport member;

a second guide member for guiding the sheet transported by said transport means to correct a curl of the sheet in cooperation with said first guide member, said second guide member being mounted on the main body of said recording apparatus, wherein one of said first and second guide members is shiftable to establish a first condition where said second guide member is located between said opening member and said first guide member, and a second condition where said second guide member is not located between said opening member and said first guide member;

image recording means, positioned along said sheet transport path, for recording an image on the sheet transported by said transport means; and moving means for moving at least one of said first guide member and said second guide member to establish the second condition when said opening member is closed, after the image recording of each page.

41. A recording apparatus comprising:

hold means for holding a sheet in a rolled state;

transport means for transporting the sheet in a first direction drawing out the rolled sheet from said hold means or in a second direction opposite thereto;

record means for effecting a recording onto the sheet transported in the first direction by said transport means;

curl correcting means for correcting a curl of the sheet transported by said transport means;

a cutter for cutting the sheet having been recorded on after completion of the recording by said record means; and drive means for driving said curl correcting means to weaken the curl correcting operation, when said transport means transports the sheet in the second direction to return a leading end thereof toward said record means, after cutting of the sheet by said cutting means.

42. A curl correcting apparatus comprising:

a sheet transport path;

an opening member openable from a main body of said curl correcting apparatus to access said sheet transport path;

transport means for transporting a sheet along said sheet transport path;

a first guide member, mounted on said opening member, for guiding the sheet transported by said transport means;

a second guide member for guiding the sheet transported by said transport means to correct a curl tendency of the sheet in cooperation with said first guide member, said second guide member being mounted onto a main body of said curl correcting apparatus, wherein one of said first and second guide members is shiftable to establish a first condition where said second guide member is located between said opening member and said first guide member, and a second condition where said second guide member is not located between said opening member and said first guide member;

moving means for moving at least one of said first and second guide members to establish the second condition not correcting the curl when said opening member is closed; and drive means for driving said moving means to move the at least one of said first and second guide members to a position not correcting the curl.

43. A curl correcting apparatus according to claim 42, wherein said drive means is adapted to drive said moving means, after image recording of each page by said image recording means, to move said first or second guide member to a position not correcting the curl.

44. A curl correcting apparatus according to claim 43, wherein said image recording means is adapted to record an image according to a received image signal.

45. A curl correcting apparatus according to claim 44, wherein said drive means is adapted to drive said moving means, after the image recording corresponding to the received image signal of a communication, to move said first or second guide member to a position not correcting the curl.

46. A curl correcting apparatus, comprising:

hold means for holding a sheet in a roll configuration;

transport means for transporting the sheet held by said hold means in a first direction drawing out the sheet from said hold means or a second direction opposite thereto;

a first guide member for guiding the sheet transported by said transport means, a second guide member cooperating with said first guide member for guiding the sheet transported by said transport means to correct the curl of the sheet;

shift means for shifting at least one of said first guide member and second guide member, in a direction weakening the curl correcting operation when the sheet is transported in the second direction by said transport means; and transmission means for transmitting a drive force of said transport means for a shift operation to said shift means.

47. A curl correcting apparatus according to claim 46, wherein said shift means shifts said first guide member so that the curl correcting operation increases as a sheet amount held in said hold means decreases.

48. A curl correcting apparatus according to claim 47, wherein said shift means has urge means for urging said first guide member in a direction to increase the curl correcting operation.

49. A curl correcting apparatus according to claim 48, wherein the sheet tension generates on said first guide member a force weakening the curl correcting operation, so that position of said first guide member is determined by the tension and force by said urge means being balanced.

50. A curl correcting apparatus according to claim 46, wherein said shift means shifts said first guide member so that the sheet is bent in a direction to correct the curl tendency as tension of the sheet generated by friction between the roller-like sheet and said hold means decreases.

51. A curl correcting means according to claim 46, further comprising support means for shiftably supporting said first guide member.

52. A curl correcting apparatus according to claim 51, wherein said support means has a rockable arm member which supports both ends of said first guide member.

53. A curl correcting apparatus according to claim 52, wherein said shift means shifts said first guide member by rocking said arm member.

54. A curl correcting apparatus according to claim 46, wherein said shift means shifts said first guide member in a direction to decrease the curl correcting operation in response to the sheet convey by said convey means in the opposite direction.

55. A curl correcting apparatus according to claim 54, wherein said apparatus has a drive source for driving said convey means and said shift means commonly.

56. A curl correcting apparatus according to claim 55, further comprising a friction clutch for frictionally transmitting the drive force of said drive source to said shift means.

57. A curl correcting apparatus according to claim 56, wherein said friction clutch shifts said first guide member in a direction to increase the curl correcting operation when said drive source drives said convey means in a direction to draw out the sheet and shifts said first guide member in the direction decreasing the curl correcting operation when said convey means is driven in an opposite direction.

58. A curl correcting apparatus according to claim 46, further comprising an one-way clutch for transmitting the drive force of said drive source.

59. A curl correcting apparatus according to claim 58, wherein said one-way clutch transmits the drive force to said shift means to shift said first guide member in a direction to thereby decrease the curl correcting operation, when said drive source shifts said convey means in a direction opposite to the sheet drawing out direction.

60. A recording apparatus, comprising:

hold means for holding a sheet wound into a roller-like configuration;

convey means for conveying the sheet held by said hold means in a direction to draw out the sheet from said hold means or in a direction opposite thereto;

record means for recording onto the sheet conveyed by said convey means;

a first guide member for guiding the sheet conveyed by said convey means;

a second guide member for guiding the sheet conveyed by said convey means and correcting a curl tendency cooperating with said first guide member; and shift means for shifting at least one of said first guide member and said second guide member to decrease the curl correcting operation when said convey means conveys the sheet in the opposite direction.

61. A recording apparatus according to claim 60, wherein said record means effects recording the image corresponding to an image signal.

62. A recording apparatus according to claim 60, wherein said record means effects recording of the image corresponding to an image signal.

63. A recording apparatus, comprising:

hold means for holding a sheet in a rolled state;

transport means for transporting the sheet in a first direction drawing out the sheet from said hold means, and for transporting the sheet in a second direction opposite to the first direction;

curl correcting means for correcting a curl of the sheet transported by said transport means;

urge means for strengthening the curl correcting operation of said curl correcting means;

transmitting means for transmitting a drive force from said transport means to said curl correcting means to weaken the curl correcting operation of said curl correcting means when said transport means transports the sheet in the second direction; and recording means for effecting a recording onto the sheet transported by said transport means.

64. A curl correcting apparatus, comprising:

hold means for holding a sheet in a rolled state;

transport means for transporting the sheet in a first direction drawing out the sheet from said hold means, and for transporting the sheet in a second direction opposite to the first direction;

curl correcting means for correcting a curl of the sheet transported by said transport means;

urge means for strengthening the curl correcting operation of said curl correcting means; and drive means for driving said curl correcting means to weaken the curl correcting operation of said curl correcting means when said transport means transports the sheet in the second direction.

65. A recording apparatus, comprising:

hold means for holding a sheet in a rolled state;

transport means for transporting the sheet in a first direction drawing out the sheet from said hold means, and for transporting the sheet in a second direction opposite to the first direction;

curl correcting means for correcting a curl of the sheet transported by said transport means;

urge means for strengthening the curl correcting operation of said curl correcting means;

drive means for driving said curl correcting means to weaken the curl correcting operation of said curl correcting means when said transport means transports the sheet in the second direction; and recording means for effecting a recording onto the sheet transported by said transport means.

* * * * *

UNITED STATES PATENT AND TRADEMARK OFFICE

CERTIFICATE OF CORRECTION

PATENT NO. : 5,533,821

DATED : July 9, 1996

INVENTOR(S) : TAKASHI AWAI, ET AL.

It is certified that error appears in the above-indentified patent and that said Letters Patent is hereby corrected as shown below:

Title page, item [56]

line 5, "Onaks et al." should read --Ondis et al.--; and line FPD, insert --54-122133 9/1979 Japan--.

Column 1, line 55, "is" should read --are--.

Column 2, line 10, "some" should be deleted; and line 16, "thereby curl" should read --thereby curling--.

Column 4, line 12, "view" should read --views--;

line 24, "FIGS. 21A 21B" should read --FIGS. 21A, 21B--; and line 50, "10" should be deleted.

Column 7, line 6, "supports" should read --support--;

line 9, "ends" should read --end--; and line 64, "wrappes" should read --wraps--.

Column 8, line 25, "G1," should read --$G_1$,--;

line 28, "rotates" should read --rotate--; and line 31, "engages" should read --engage--.

UNITED STATES PATENT AND TRADEMARK OFFICE

CERTIFICATE OF CORRECTION

PATENT NO. : 5,533,821
DATED : July 9, 1996
INVENTOR(S) : TAKASHI AWAI, ET AL.

It is certified that error appears in the above-indentified patent and that said Letters Patent is hereby corrected as shown below:

Column 9,
line 25, "10" should be deleted; and
line 30, "is" should read --is in--.Column 10,
line 33, "state" should read --state,--.
Column 15,
line 65, "shaft. 122." should read --shaft 122.--.
Column 19,
line 65, "shaft 122" should read --shaft 22--.
Column 20,
line 37, "122 and 123" should read --22 and 23--.
Column 23,
line 37, "to" should read --according to--; and
line 59, "and" should be deleted.
Column 24,
line 12, "curl correcting" should read --recording--;
line 16, "curl correcting" should read --recording--;
line 19, "curl correcting" should read --recording--;
and
line 32, "member;" should read --means;--.

UNITED STATES PATENT AND TRADEMARK OFFICE

CERTIFICATE OF CORRECTION

PATENT NO. : 5,533,821

DATED : July 9, 1996

INVENTOR(S) : TAKASHI AWAI, ET AL.

It is certified that error appears in the above-indentified patent and that said Letters Patent is hereby corrected as shown below:

Column 26, line 42, "claim 46," should read --claim 55,-- and line 43, "an" should read --a--.

Signed and Sealed this

Nineteenth Day of November, 1996

*Attest:*

*Attesting Officer*

BRUCE LEHMAN

*Commissioner of Patents and Trademarks*